US008205529B1

(12) United States Patent
Laurie

(10) Patent No.: US 8,205,529 B1
(45) Date of Patent: Jun. 26, 2012

(54) HYBRID LOW PROFILE AND STANDARD RATCHET SYSTEM

(76) Inventor: Mark Laurie, Palm Beach Gardens, FL (US)

( * ) Notice: Subject to any disclaimer, the term of this patent is extended or adjusted under 35 U.S.C. 154(b) by 0 days.

(21) Appl. No.: 12/897,775

(22) Filed: Oct. 4, 2010

Related U.S. Application Data

(63) Continuation-in-part of application No. 12/332,328, filed on Dec. 10, 2008, now abandoned.

(60) Provisional application No. 61/012,793, filed on Dec. 11, 2007.

(51) Int. Cl.
*B25B 23/16* (2006.01)
*B25B 13/46* (2006.01)

(52) U.S. Cl. ..... 81/177.85; 81/60

(58) Field of Classification Search ..... 81/177.85, 81/124.6, 177.2, 124.3, 125, 119, 185, 177.75
See application file for complete search history.

(56) References Cited

U.S. PATENT DOCUMENTS

| | | | | | |
|---|---|---|---|---|---|
| 5,009 | A | | 3/1847 | Avery | |
| 61,340 | A | | 1/1867 | Jackson | |
| 461,771 | A | * | 10/1891 | Cottrell | 81/185 |
| 493,273 | A | | 3/1893 | Killinger | |
| 603,377 | A | | 5/1898 | Fitch | |
| 845,716 | A | | 2/1907 | Miller | |
| 886,476 | A | | 5/1908 | Burnop | |
| 959,690 | A | | 5/1910 | Anderson | |
| 963,895 | A | | 7/1910 | Houghton | |
| 1,121,668 | A | | 12/1914 | Rusk et al. | |
| 1,403,161 | A | * | 1/1922 | Harralson | 81/119 |
| 1,428,982 | A | | 9/1922 | Reese | |
| 1,451,498 | A | | 4/1923 | Faitz | |
| 2,530,553 | A | | 11/1950 | Strobell | |
| 2,551,553 | A | * | 5/1951 | Wahl | 81/125 |
| 2,758,569 | A | | 8/1956 | Peterson | |
| 2,766,648 | A | | 10/1956 | Jazwieck | |
| 4,304,157 | A | | 12/1981 | Yamada et al. | |
| 5,295,422 | A | | 3/1994 | Chow | |
| 5,653,151 | A | | 8/1997 | Blacklock | |
| 5,709,137 | A | | 1/1998 | Blacklock | |
| 5,768,957 | A | | 6/1998 | Baker | |
| 5,857,390 | A | | 1/1999 | Whiteford | |
| 5,901,620 | A | * | 5/1999 | Arnold | 81/177.2 |
| D425,385 | S | | 5/2000 | Jarvis | |
| D425,770 | S | | 5/2000 | Hsieh | |
| 6,282,994 | B1 | * | 9/2001 | Wei | 81/121.1 |
| 6,332,382 | B1 | * | 12/2001 | Anderson et al. | 81/125 |
| 6,748,824 | B2 | * | 6/2004 | Chen | 81/177.85 |
| 7,000,504 | B2 | * | 2/2006 | Chen | 81/60 |
| 7,104,163 | B2 | | 9/2006 | Hu | |
| 7,143,669 | B2 | * | 12/2006 | Hu | 81/177.85 |
| 2006/0288825 | A1 | * | 12/2006 | Hu | 81/177.2 |

* cited by examiner

*Primary Examiner* — Hadi Shakeri
(74) *Attorney, Agent, or Firm* — Glenn E. Gold; H. John Rizvi; Gold & Rizvi, P.A.

(57) ABSTRACT

A low profile ratchet wrench incorporates a ratchet gear drive having a female section of a socket or tool drive interface. The socket incorporates a male section for attaching the socket to a ratchet drive head section. By utilizing a female section of the interface in the wrench, the projected height of the socket is reduced as compared to a standard socket. An optional female section can be a cavity provided within the male section of the socket or other tool, allowing the tool to be used on both a standard wrench and a low profile wrench. A snap ring is disposed within a recession about an engaging end of the male section. The snap ring rests against a chamfer in a peripheral edge of the female drive tool interface securing the socket with the gear. Accessories can include attaching section style adapters, size adjusting adapters, extensions, universal joints, and wobble features.

25 Claims, 43 Drawing Sheets

HYBRID LOW PROFILE AND STANDARD RATCHET SYSTEM

CROSS-REFERENCE TO RELATED APPLICATIONS

This Non-Provisional Utility application is a Continuation-In-Part of co-pending Non-Provisional application Ser. No. 12/332,328, filed on Dec. 10, 2008, which claims the benefit of U.S. Provisional Patent Application Ser. No. 61/012,793, filed on Dec. 11, 2007, both of which are incorporated herein in their entirety.

BACKGROUND OF THE INVENTION

1. Field of the Invention

The present invention relates generally to socket based drive tools. More specifically, the invention relates to a socket based drive tool system adapted to be utilised in either a conventional or a low profile configuration.

2. Discussion of the Related Art

Fastener insertion tools utilize a fastener drive tool engaging with a ratchet wrench. The common engaging interface utilises a square plug projecting from wrench ratcheting head which inserts into a receptacle cavity within a base of the fastener drive tool. The plug extends a distance from the wrench governs a minimal profile between the rear of the wrench handle and the distal end of the tool. It is desirable that the minimal profile be as small as possible allowing the user to insert the tool into narrow gaps.

Socket size adapters are designed having a male plug on one end and a female receptacle on the opposing end. This additionally increases the minimal profile.

Many people have collected an assortment of tools over time. Sockets in particular, are a family of tools that have been fabricated based upon some common design factors allowing components to be interchangeable.

What is desirable is a tool having a low profile with minimal impact with existing tools.

SUMMARY OF THE INVENTION

A first aspect of the present invention is a fastener drive tool having:

a tool body having a base end and an opposite fastener engaging end, the base and fastener engaging ends concentric about a longitudinal axis;

an external socket drive interface concentric about the longitudinal axis, the external socket drive interface defined by a base end non-circular exterior surface;

an internal socket drive interface concentric about the longitudinal axis, the internal socket drive interface defined by a non-circular base end cavity concentric about the longitudinal axis; and a releasable locking feature integrated into the external socket drive interface, the releasable locking feature comprising a snap ring positioned within a recess about a circumference of the external socket drive interface, wherein the snap ring is designed to reduce a diameter when subjected to compression.

Another aspect of the present invention incorporates a second releasable locking feature disposed within the internal socket drive interface.

Yet another aspect utilizes a ratchet wrench comprising a receptacle having a size and shape for engaging with the external socket drive interface.

With another aspect providing a releasable locking feature that is selected from a group comprising:

a. a spring operated locking bearing,
b. a locking bearing detent,
c. an O-ring,
d. a snap ring, and
e. an elastomeric nib.

Regarding another aspect of the present invention, the fastener drive tool having a fastener interface of:

a. a hex socket tool,
b. a twelve-point socket tool,
c. a square drive tool, and
d. a star drive tool.

While yet another aspect of the present invention, the fastener drive tool having a fastener interface of:

a. a hex drive tool,
b. a flat head screwdriver tool,
c. a Phillips head screwdriver tool,
d. a square drive tool, and
e. a star drive tool.

In another aspect, the ratchet wrench includes a gear drive having a pass through socket receptacle. The pass through socket receptacle includes a chamfer about at least one exposed edge.

In another aspect, the dual interface socket includes a male adapter for engaging with the corresponding female pass through socket receptacle. The preferred cross sectional shape of the interface is a hexagon. It is understood alternate shapes include an octagon, a pentagon, a square, a star, an oval, a "D", a slotted circle, and the like.

In another aspect, a metal snap ring is assembled within a receiving slot provided about a receptacle drive section proximate a ratchet receiving end of the socket.

In another aspect, the metal snap ring and the receiving slot are sized, allowing the metal snap ring to contract within the receiving slot allowing passage through the female pass through socket receptacle.

In another aspect, the metal snap ring and the receiving slot are sized, allowing the metal snap ring to contract within the receiving slot allowing passage through the female pass through socket receptacle.

In another aspect, the metal snap ring is sized to remain within the receiving slot when placed in a relaxed state.

In another aspect, the receptacle drive section includes a plurality of planar plug drive sections each section comprises a drive transition section located proximate a socket body. The drive transition section extends outward from the planar plug drive sections and is sized to rest against the chamfer about the edge of the pass through socket receptacle. The metal snap ring is located at a distance to rest against the chamfer about the opposite edge of the pass through socket receptacle.

Adding another aspect, the drive tool can incorporate additional features such as a universal joint, a wobble engaging interface, an extension, an adapter, a low profile to standard socket converter, and the like.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the various views of the drawings.

DETAILED DESCRIPTION OF THE PREFERRED EMBODIMENTS

Figure 1:
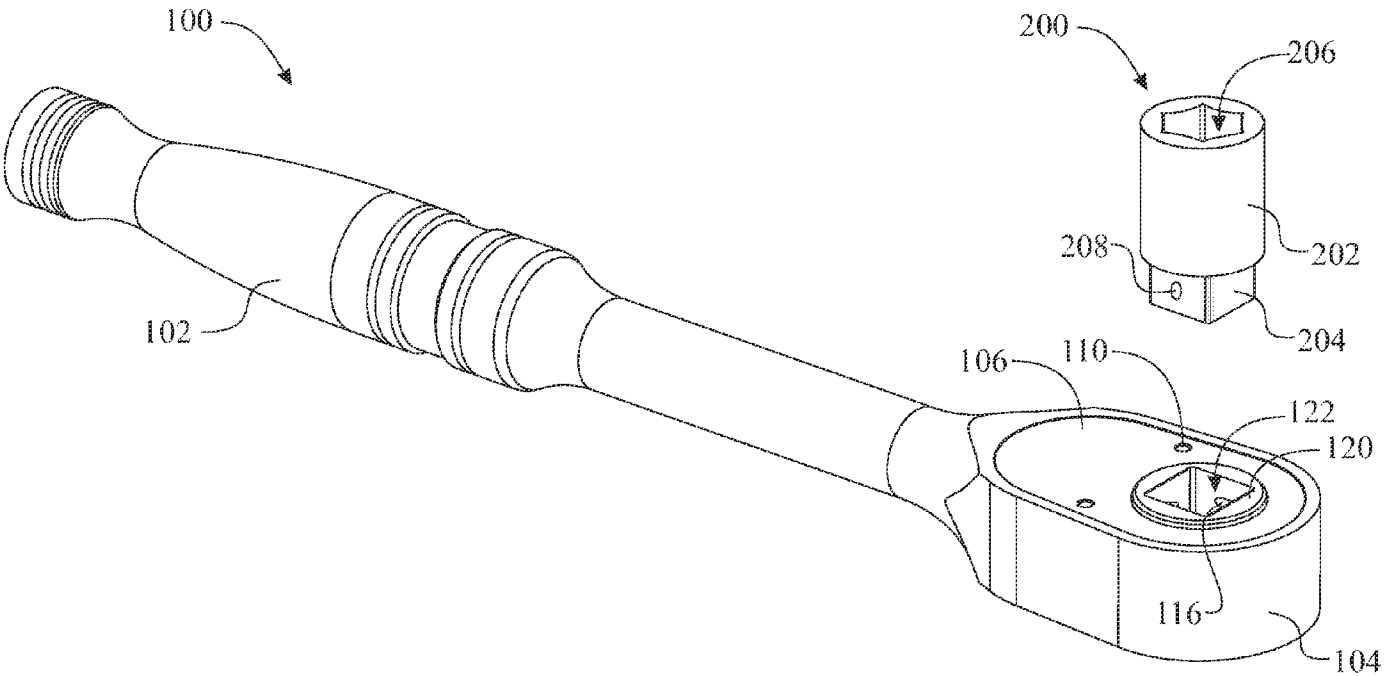
FIG. 1 presents an isometric, front view of a receptacle drive ratchet wrench and respective plug attachment portion interface socket.
Figure 2:
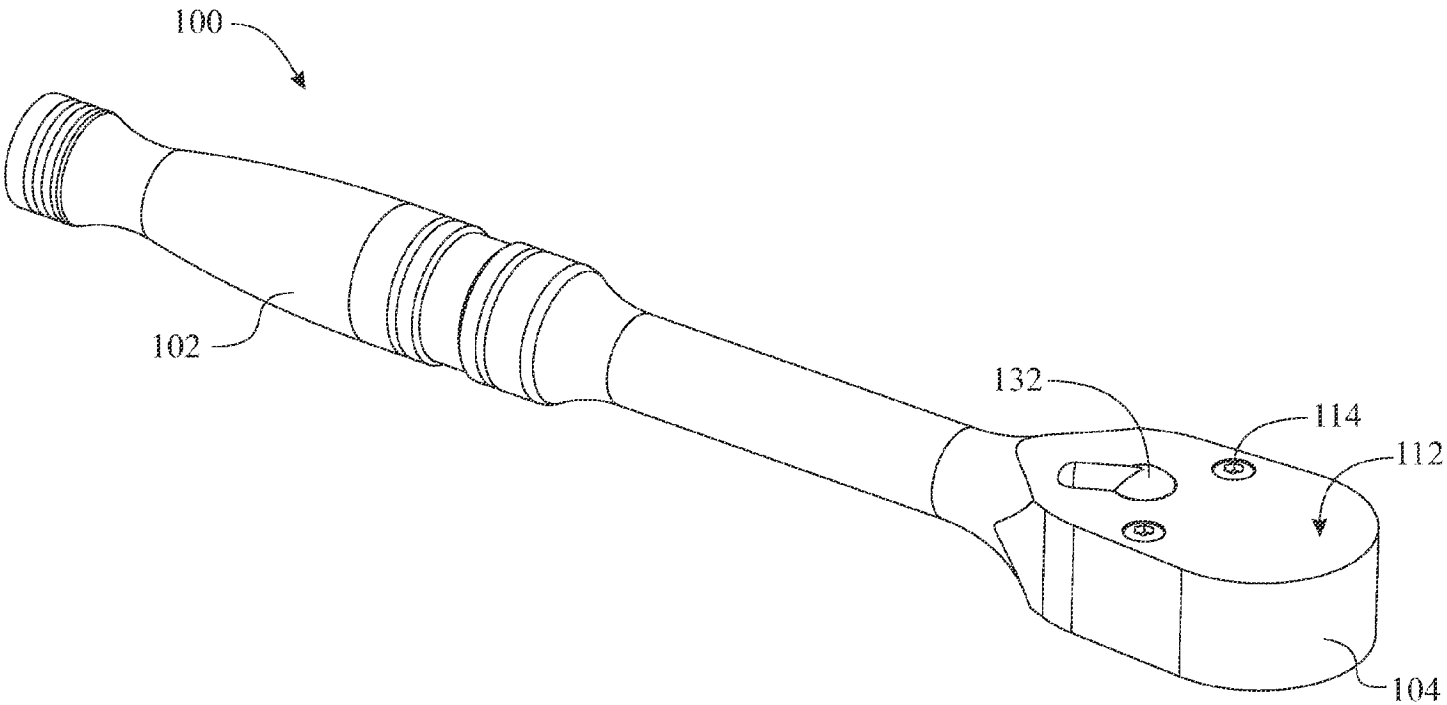
FIG. 2 presents an isometric, rear view of the receptacle drive ratchet wrench as presented in FIG. 1.
Figure 3:
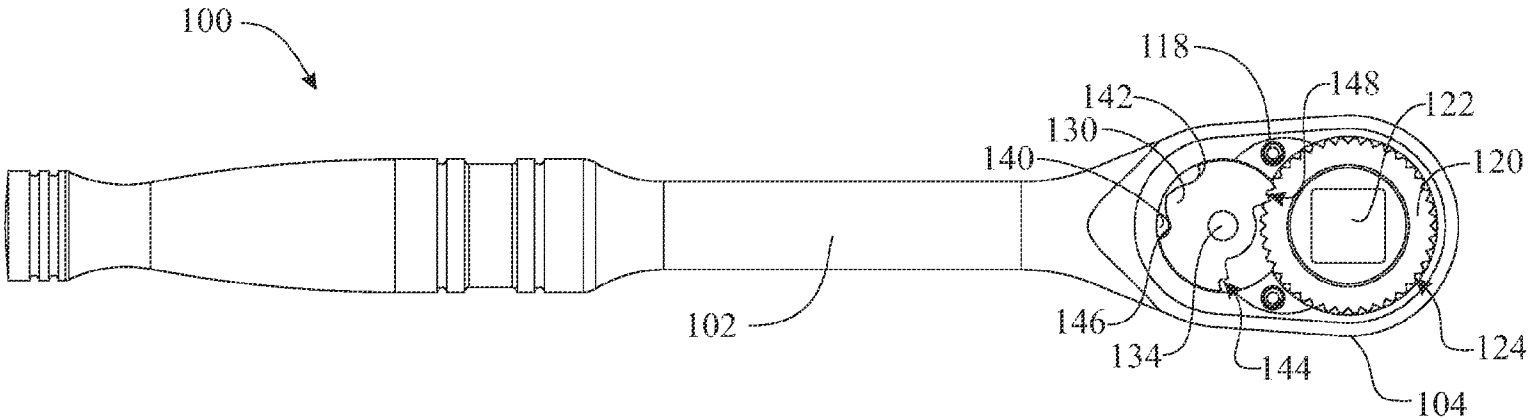
FIG. 3 presents a top view of the receptacle drive ratchet wrench as presented in FIG. 1 with a gear assembly cover plate removed.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring primarily to FIGS. 1-5, an exemplary embodiment of a receptacle-based drive ratchet 100 will now be described. The receptacle-based drive ratchet 100 has a ratchet handle section 102 and a ratchet drive section 104. The ratchet handle section 102 provides leverage for the securing or removing a threaded fastener, while the ratchet drive section 104 provides a ratchet wrench interface to a socket or other driver tool. The ratchet drive section 104 includes a receptacle-based drive gear 120 having a socket attachment receptacle 122 for receiving a plug drive section 204 of a plug-based drive socket 200. The socket attachment receptacle 122 reduces the overall height required for the tool vis-á-vis conventional socket wrenches having a corresponding male socket attachment interface. The receptacle-based drive gear 120 is provided in a drive gear receiving cavity 128, for engaging a drive gear directional control 130. The drive gear directional control 130 pivots about a directional control lever shaft 134 via a drive gear directional control lever 132. In this manner, the lever enables selective engagement of drive gear teeth 124 with counterclockwise drive teeth 144 or clockwise drive teeth 148. The drive gear directional control 130 provides a ratcheting motion to the receptacle-based drive gear 120 through engagement with drive gear teeth 124. A directional control locking bearing 140 is positioned to engage a counter-clockwise drive latch feature 142 or a clockwise drive latch feature 146, maintaining the drive gear directional control 130 in the desired position for either securing or removing a threaded fastener. The receptacle-based drive gear 120 and drive gear directional control 130 are contained within the ratchet drive section 104 via a drive gear assembly cover plate 106. The drive gear assembly cover plate 106 can be secured to the ratchet drive section 104 via a pair of cover plate fasteners 114. The cover plate fasteners 114 are inserted from a ratchet head back section 112 of the ratchet drive section 104, through a body fastener sleeve 118, and secured by rotating the fastener threading 115 into gear assembly cover plate fastening threads 110 of the drive gear assembly cover plate 106. Alternatively, a snap ring, rivets and other known attachment mechanism can be used. When the ratchet drive section 104 is fully assembled, the gear 120 is contained within the ratchet drive section 104, with the planar bottom surface of gear 120 contacting the base of cavity 128, the gear teeth 124 contacting the sidewall of cavity 128, and the drive gear shoulder 126 in contact with the interior surface of cover plate 106. The socket attachment receptacle 122 projects through a drive gear port 108 of the drive gear assembly cover plate 106.

Figure 8:
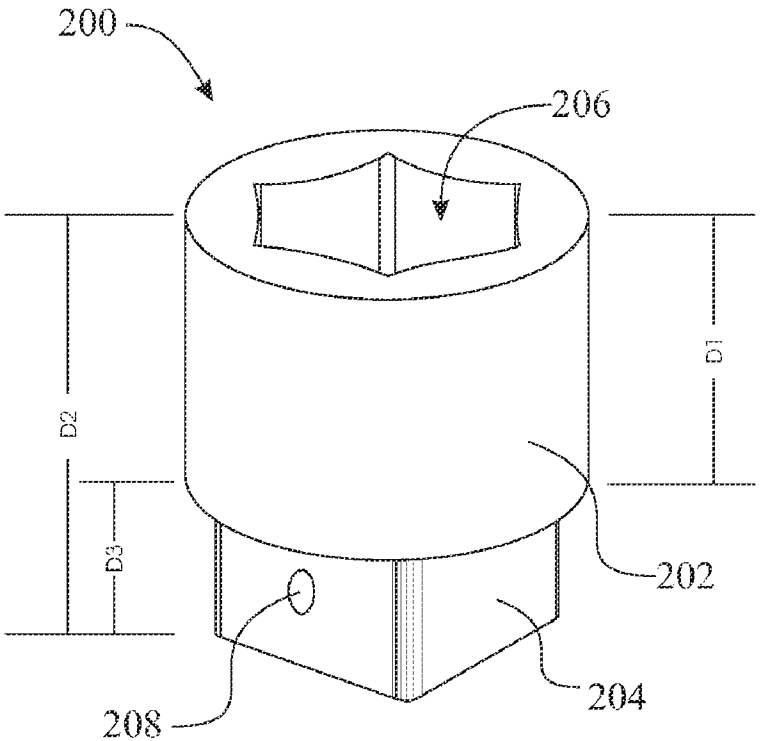
FIG. 8 presents an isometric view of a low profile socket having a plug attaching portion of FIG. 1.
Figure 11:
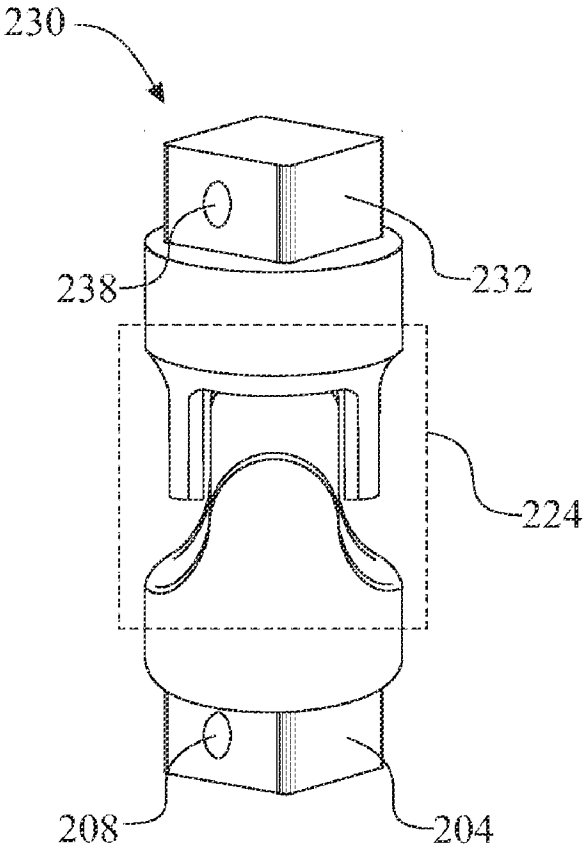
FIG. 11 presents an isometric view of a receptacle-based to conventional based adapting universal joint.
Figure 10:
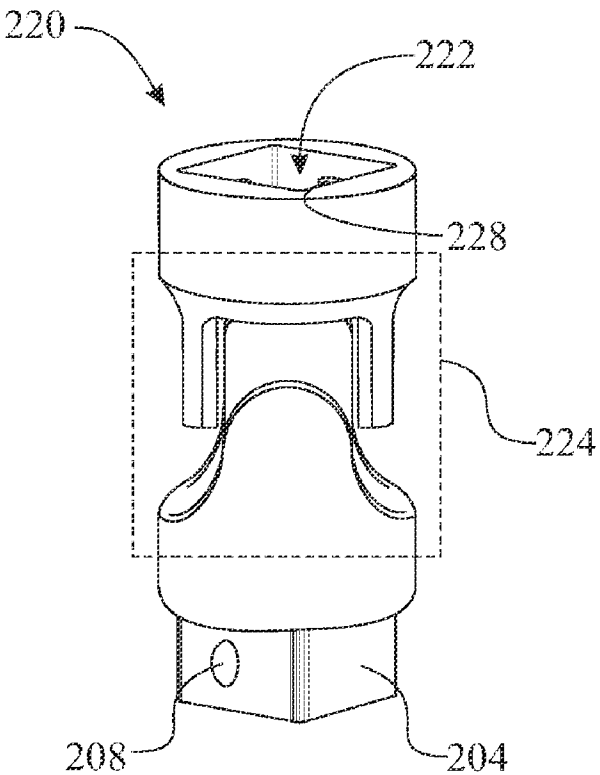
FIG. 10 presents an isometric view of a pass through coupling universal joint.
Figure 13:
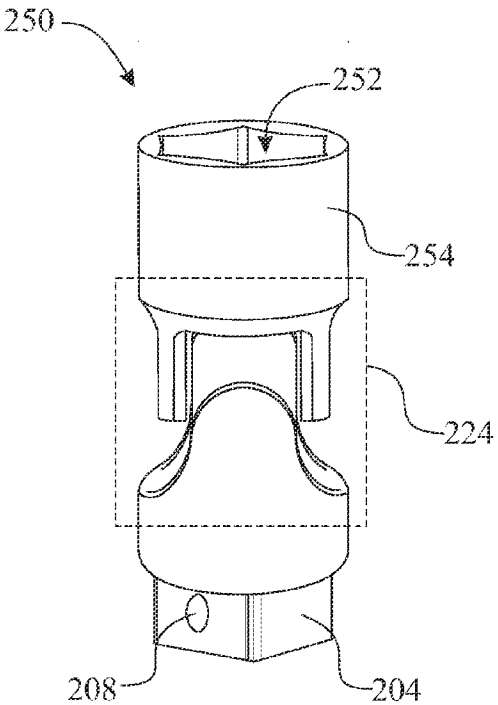
FIG. 13 presents an isometric view of a flank drive universal socket.
Figure 12:
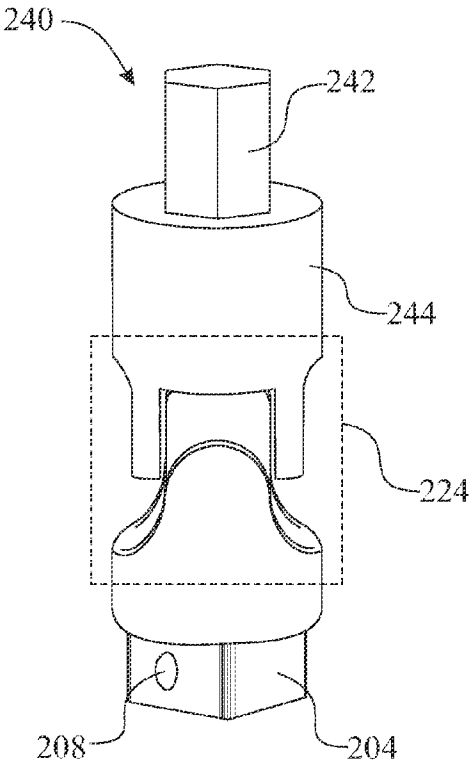
FIG. 12 presents an isometric view of an integrated universal drive and tool tip.

Referring now primarily to FIGS. 1 and 8, a plug-based drive socket 200 is provided for releasable attachment to the ratchet 100. A fastener head receiving cavity 206 is provided is axially aligned with the centerline of socket body 202 of the plug-based drive socket 200, providing a coupling for a respectively shaped head or nut of a fastener. The six-sided fastener head receiving section 206 is merely exemplary. It is understood that the head receiving cavity can be provided having myriad arrangements of sides and geometries for engaging different corresponding fastener geometries. Additional tool interface designs will be shown and/or described herein; however, the teachings are not limited to those presented. Plug drive portion 204 is provided at and extends downward from a base of socket body 202. A ratchet locking bearing 208 is assembled into at least one side of the plug drive section 204. The ratchet locking bearing 208 cooperates with a locking bearing receiving detent 116 provided in the four interior walls of the socket attachment receptacle 122 to releasably secure the drive tool 200 within receptacle 122. The four locking bearing receiving detents 116 enable insertion of the plug drive 204 into the receptacle 122 in any orientation. An elastomeric nib can be used as an alternate to the ratchet locking bearing 208.

Figure 7:
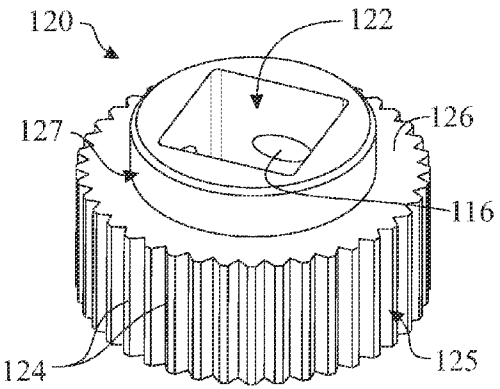
FIG. 7 presents an isometric, top view of the drive gear of FIG. 5.
Figure 5:
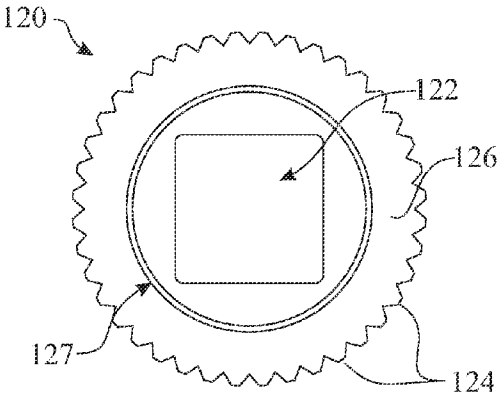
FIG. 5 presents a top view of a drive gear having a receptacle portion of the socket attaching interface.
Figure 6:
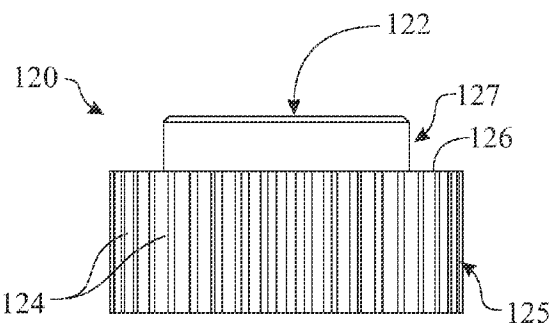
FIG. 6 presents a side view of the drive gear of FIG. 5.

Referring now primarily to FIGS. 5-7, receptacle-based drive gear 120 is shown in more detail. A top view of receptacle-based drive gear 120 is shown in FIG. 5, a side view is shown in FIG. 6, and an isometric view is shown in FIG. 7. The drive gear 120 has a unitary, or one-piece, construction, generally defined by a lower body portion 125 and an upper body portion 127, separated by a shoulder 126. Socket attachment receptacle 122 can comprise a cavity extending partially through the drive gear, or an aperture extending completely through the drive gear 120. The socket attachment receptacle 122 can be provided having four walls (as shown), each having a locking bearing receiving detent 116 provided therein. Teeth 124 are provided about a circumference of the receptacle-based drive gear 120. As is well known, the quantity of teeth 124 is proportional to the quantity of ratchet engagement angles. Accordingly, increasing the quantity of teeth 124 correspondingly increases the number of angles at which the handle can engage the receptacle-based drive gear 120. The socket attachment receptacle 122 extends completely through the drive gear upper body portion 127 and at least partially through the drive gear lower body portion 125. When fully assembled, the drive gear upper body portion 127 projects through the drive gear port 108 of the drive gear assembly cover plate 106, while the drive gear shoulder 126 remains entrapped beneath an interior surface of the drive gear assembly cover plate 106.

Figure 9:
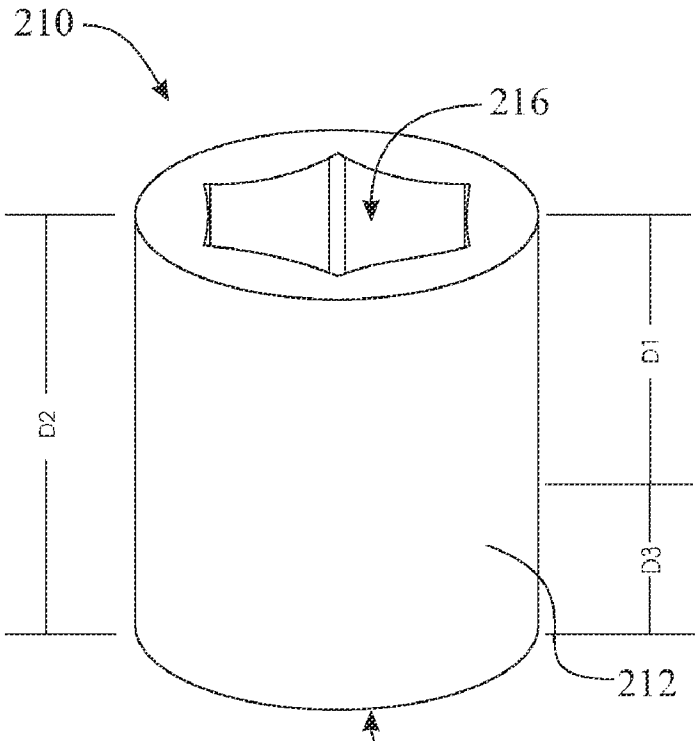
Prior Art FIG. 9
FIG. 9 presents an isometric view of a standard socket having a receptacle attaching portion, presenting a profile height comparison with the low profile socket of FIG. 8.

The beneficial impact of the low profile construction of the invention is illustrated in FIGS. 8 and 9, wherein the dimensions of the present plug-based drive socket 200 (FIG. 8) are directly compared with the dimensions of a conventional receptacle-based socket 210 (FIG. 9). The prior art socket 210 includes a uniform outer diameter socket body 212 having a fastener head receiving section 216. Both the present plug-based drive socket 200 and the standard receptacle-based socket 210 have an overall height D2. Both sockets have a socket dept, D1, for receiving a fastener. The socket of present invention provides a distinct profile reducing advantage; namely, an attaching dimension or distance, D3, is inserted into the socket attachment receptacle 122 of the receptacle-based drive ratchet 100 reducing the exposed tool height from the overall height D2 to the socket depth D1.

The receptacle-based drive ratchet 100 generates an inventive portfolio of attachments, with a variety of exemplary attachments presented in FIGS. 10-21. A set of exemplary universal joint attachments is presented in FIGS. 10-13. Each exemplary universal joint attachment includes a plug drive section 204 having a ratchet locking bearing 208, a universal joint section 224, and a tool end, whereby each tool end differs. A pass-through coupling universal joint 220 incorporates a socket connecting receptacle 222 at the tool end, wherein the socket connecting receptacle 222 could be of the same dimensions as the socket attachment receptacle 122—providing a gimbaled pass through tool attachment. The pass-through coupling universal joint 220 includes a set of four locking bearing receiving detents 228, replicating the complete attaching means of the receptacle-based drive gear 120. A receptacle-based to conventional plug-based adapting universal joint 230 incorporates a plug-based attaching section 232 at the tool end, providing a gimbaled converter changing from a female attaching section to a male attaching section. The plug-based attaching section 232 could have dimensions corresponding to the socket attachment receptacle 122 or different (i.e., larger or smaller) receptacle dimensions, thereby additionally providing a size-adapting capability. An integrated universal drive and tool tip 240 incorporates a tool tip 242 at the tool end, wherein the tool tip 242 is either removable or permanently coupled to a tool tip holder 244. The tool tip 242 is illustrated as a Hex-key style; however, it is understood that the tool tip 242 can be adapted to the geometries and sizes of any existing or future designed driving tool. Additional examples can include, but are not limited to, Philips head bits, flat head bits, Torx bits, square drive bits, and ball end hex key bits. For a removable version, the tool tip holder 244 can incorporate a ¼" hex shaped, bit receiving section (not shown but understood). A flank drive universal socket 250 incorporates a fastener head receiving section 252 at the tool end, wherein the fastener head receiving section 252 is provided within a socket body 254. The fastener head receiving section 252 can be of any shape or size commonly known for driving or removing a fastener.

Figure 14:
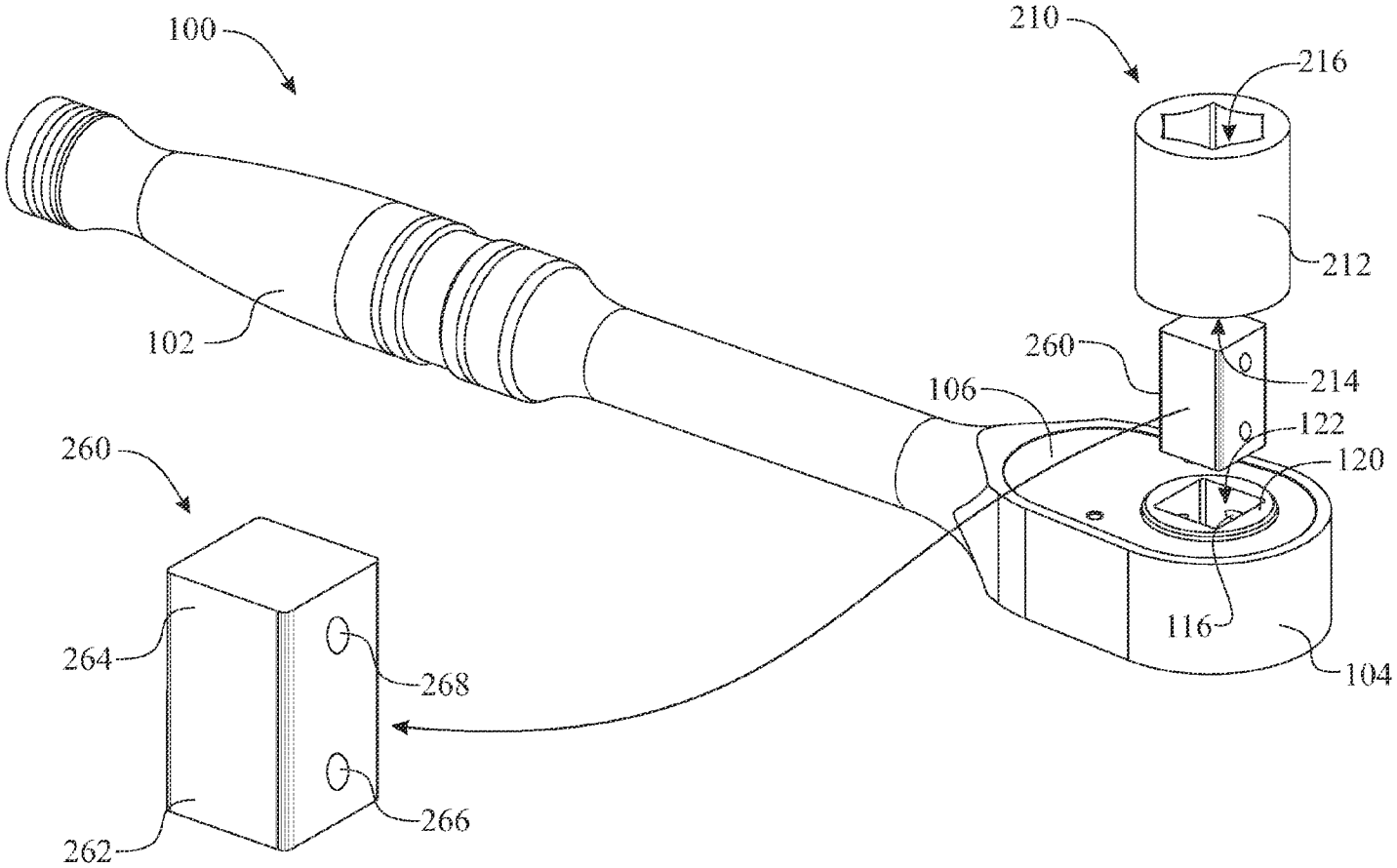
FIG. 14 presents an isometric view of the receptacle-based socket attaching interface ratchet wrench of FIG. 1, the illustration further presenting a receptacle-based to standard interface based converter and respective standard ratchet wrench interface socket.
Figure 15:
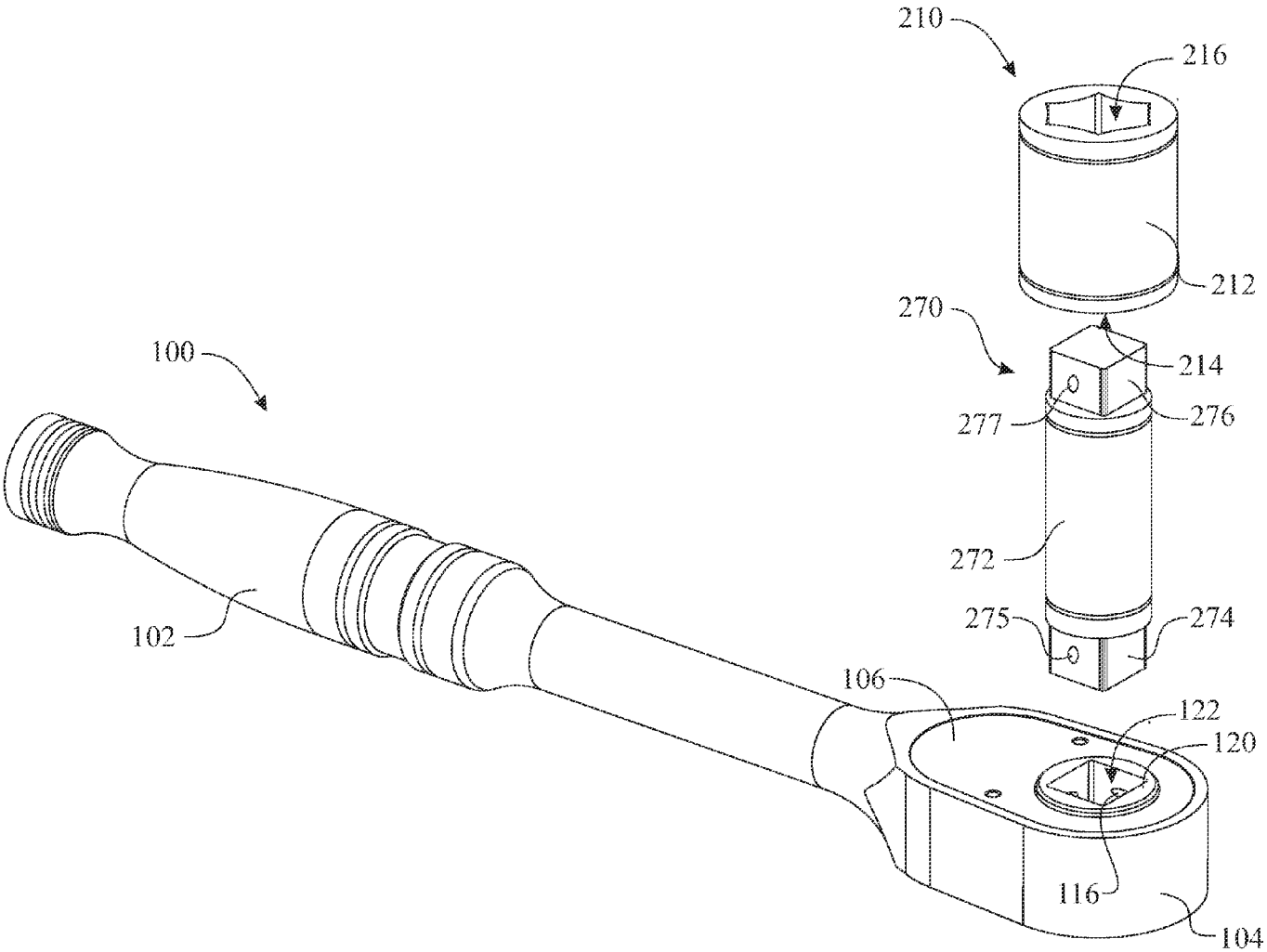
FIG. 15 presents an isometric view of the receptacle-based socket attaching interface ratchet wrench of FIG. 1, the illustration further presenting a receptacle-based to conventional based adapting extension and converter, further including the respective standard wrench ratchet interface socket.
Figure 16:
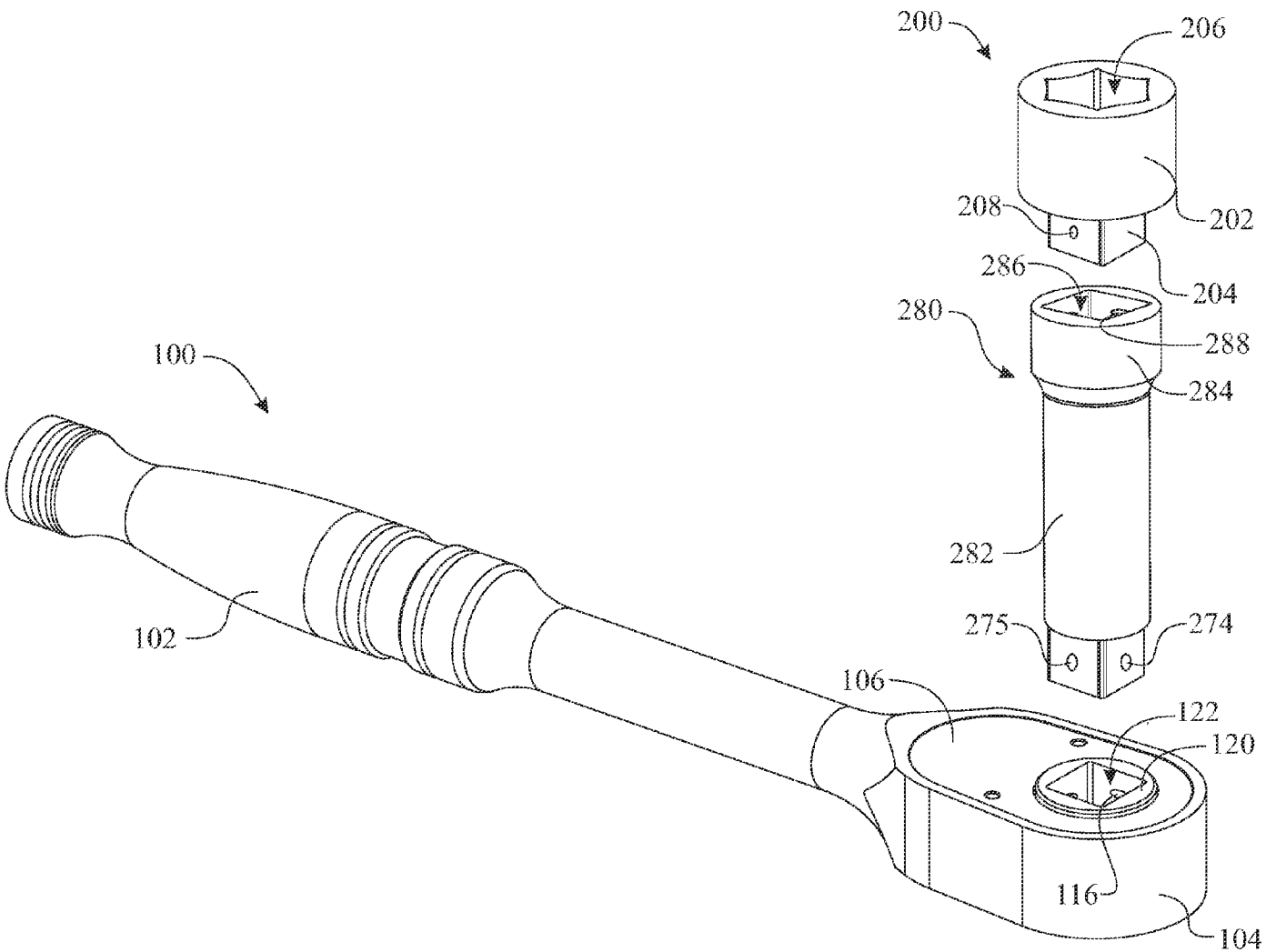
FIG. 16 presents an isometric view of the receptacle-based socket attaching interface ratchet wrench of FIG. 1, the illustration further presenting a receptacle-based to receptacle-based interface extension, further including the respective male portion attaching interface socket.

Various adapters and extensions providing broader applications are presented in FIGS. 14-19. As shown in FIG. 14, a receptacle-based to plug-based drive converter 260 includes a ratchet plug portion attachment section 262 on a first end, and a socket plug portion attachment section 264 on the opposite end. A ratchet locking bearing 266 is provided corresponding to the ratchet plug portion attachment section 262. Likewise a socket locking bearing 268 is provided corresponding to the socket plug portion attachment section 264. The drive converter 260 provides the user the ability to use the standard receptacle-based socket 210 in conjunction with the female interfacing drive ratchet 100. The drive converter 260 is inserted into the socket attachment receptacle 122, bringing the ratchet locking bearing 266 in engagement with the locking bearing receiving detent 116. The socket plug portion attachment section 264 is inserted into the socket connecting receptacle 214 of the standard receptacle-based socket 210, and secured, via the socket locking bearing 268, into a recess similar to the locking bearing receiving detent 116 of the receptacle-based drive gear 120. As shown in FIG. 15, a female-to-male drive extension and converter 270 provides another embodiment of the receptacle-based to plug-based drive converter 260. It includes an extension body 272, providing an extended distance between a ratchet plug portion attachment section 274 and a socket plug portion attachment section 276. The female-to-male drive extension and converter 270 provides the user with the ability to utilize a standard receptacle-based socket 210 in conjunction with the receptacle-based drive ratchet 100, while maintaining the ratchet handle section 102 a distance away from the end of the standard receptacle-based socket 210. Each male attachment section 274, 276, incorporates a respective locking bearing 275, 277. As shown in FIG. 16, a socket extension 280 provides an extension, including a socket extension body 282 having the ratchet plug portion attachment section 274 disposed at the ratchet end of the socket extension body 282, and a receptacle-based attachment body 284 disposed at the socket end of the socket extension body 282. A socket connecting receptacle 286 is provided within the receptacle-based attaching body 284. A set of four locking bearing receiving detents 288 are provided for receiving the ratchet locking bearing 208 of the plug-based drive socket 200.

Referring now primarily to FIGS. 17-21, three different tool attachment size adapters are shown, including an illustration of the prior art (FIG. 18) to demonstrate the reduced spacing dimension requirements. A socket receptacle reducer 290 is used in applications where the dimensions of the plug drive section 204 of the plug-based drive socket 200 are smaller than the dimensions of the socket attachment receptacle 122 of the female interfacing drive ratchet 100. The socket receptacle reducer 290 is designed having a reducing body 292 and a reduced drive receptacle 294 provided therein. A set of four locking bearing receiving detents 298 can be provided along the interior wall surfaces of the reduced drive receiving section 294. The locking bearing receiving detents 298 are provided for releasably engaging the corresponding ratchet locking bearing 208 of the plug-based drive socket 200. A ratchet locking bearing 296 can be integrated into one of the exterior surfaces of the reducing body 292 for securing the socket receptacle reducer 290 into the socket attachment receptacle 122 of the female interfacing drive ratchet 100. One of the advantages of the present invention is best illustrated through a comparison of the configurations of FIGS. 18 and 19.

Figure 17:
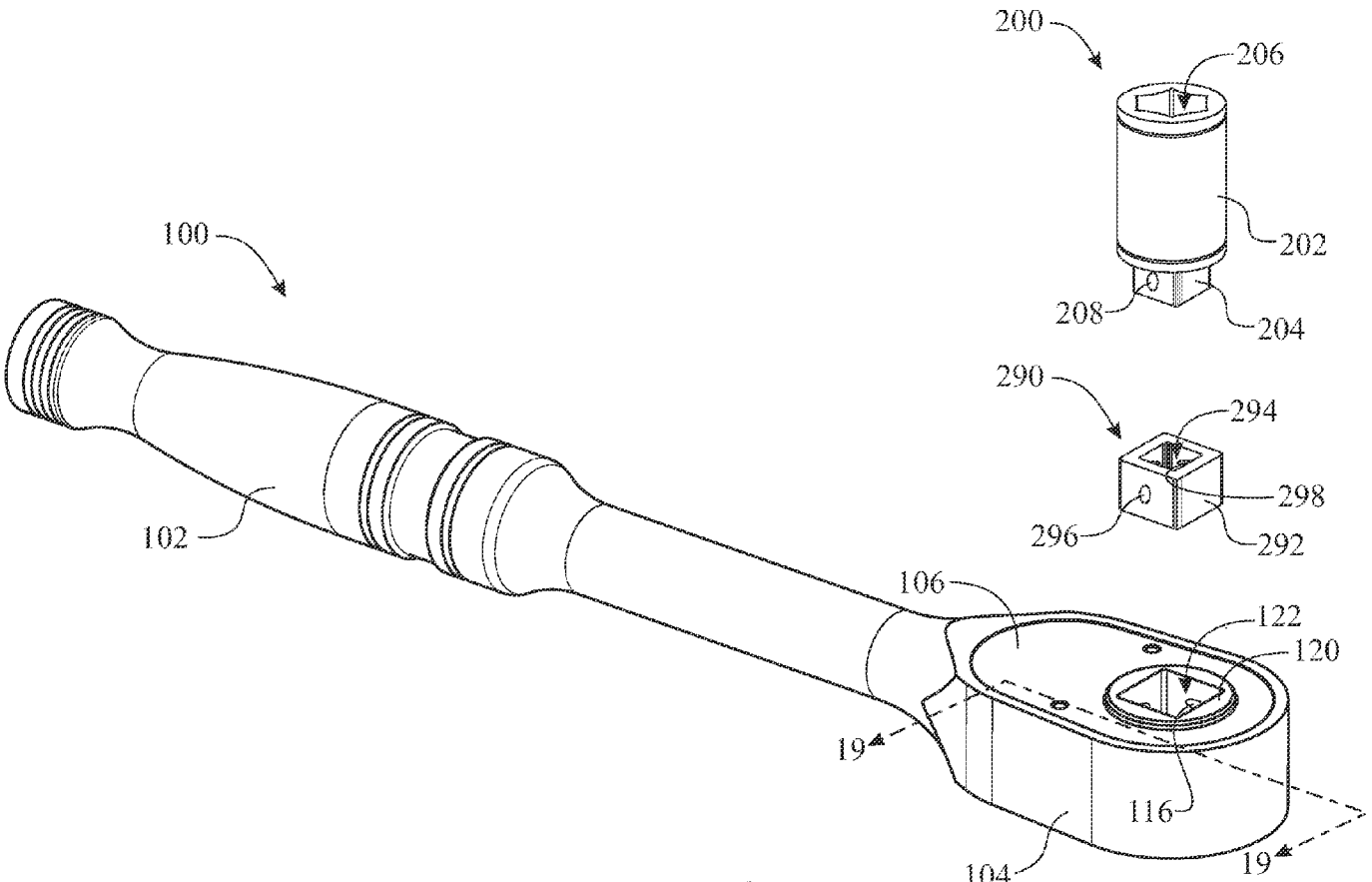
FIG. 17 presents an isometric view of the receptacle-based socket attaching interface ratchet wrench of FIG. 1, the illustration further presenting a receptacle to receptacle socket reducer and respective plug attachment portion socket.
Figure 19:
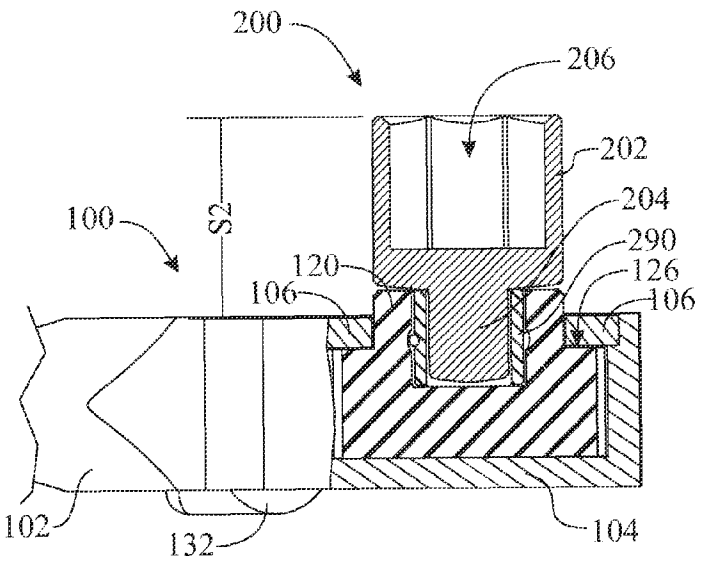
FIG. 19 presents a sectional view of a socket drive size adapter in accordance with the prior art, illustrating the reduced dimensional requirements provided when using the inventive receptacle-based socket and receptacle to receptacle socket reducer.
Figure 18:
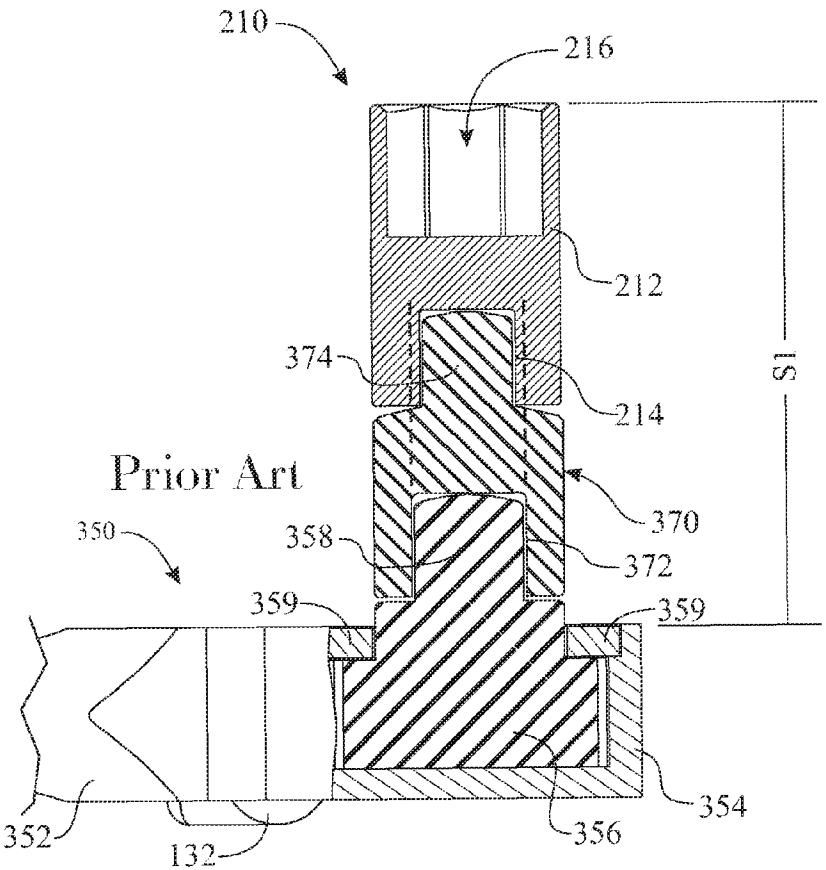
FIG. 18 presents a sectional view of a socket drive size adapter in accordance with the prior art, illustrating the dictated dimensional requirements.
Figure 20:
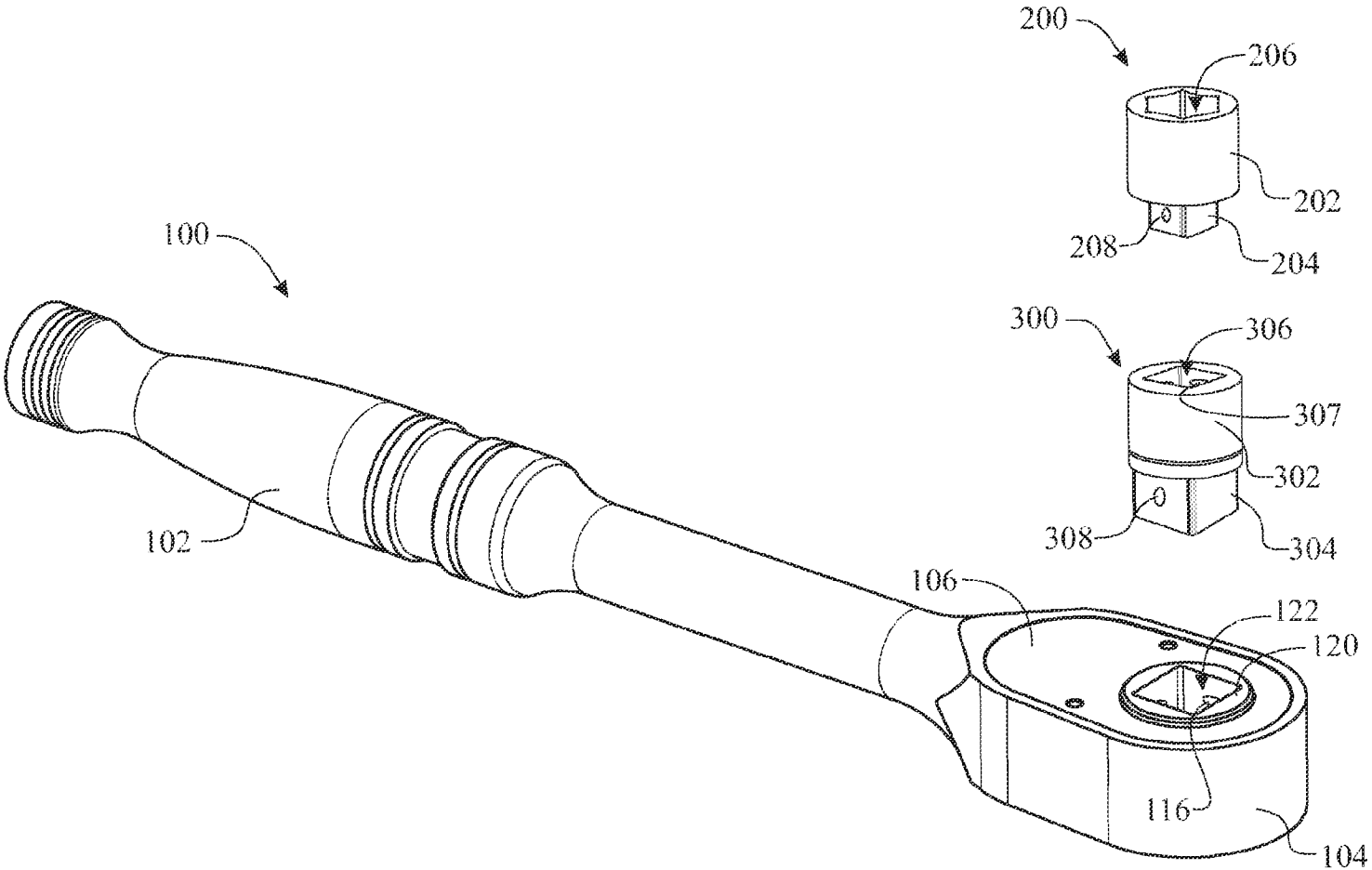
FIG. 20 presents an isometric view of the receptacle-based socket attaching interface ratchet wrench of FIG. 1, the illustration further presenting a receptacle to receptacle socket size adapter and respective plug attachment portion socket.

A sectional view of a standard plug-based drive ratchet 350, including a currently available drive size adapter 370, is shown in FIG. 18. A sectional view of the receptacle-based drive ratchet 100, incorporating the socket receptacle reducer 290, is shown in FIG. 19. The currently available drive size adapter 370 reduces the dimensions of a plug-based drive attaching section 358 to the next smaller standard size plug via an adapter plug section 374, wherein the adapter plug section 374 is disposed on the opposite end of the currently available drive size adapter 370. The plug-based drive attaching section 358 is inserted into an adapter receptacle section 372 of the currently available drive size adapter 370. The adapter plug section 374 is then inserted into the socket connecting receptacle 214 of the standard receptacle-based socket 210. The resulting configuration requires a space, S1, for use. In comparison, the assembly presented in FIG. 19, previously described with respect to FIG. 17, illustrates a greatly reduced space requirement, S2. Due to the shape of the socket receptacle reducer 290, it is desirable to have an ejection feature to facilitate the removal of the socket receptacle reducer 290 from the socket attachment receptacle 122. The socket receptacle reducer 290 is limited to a reducing attachment, whereas a drive size adjusting adaptor 300 is not size limited, thereby allowing for a plug drive section 204 that is larger or smaller than the socket attachment receptacle 122. The drive size adjusting adaptor 300 includes a size adapting body 302 having a size adapting drive receiving section 306 provided therein. The size adapting drive receiving section 306 is dimensioned to accept a plug drive section 204 having a different dimensioned socket attachment receptacle 122. A ratchet plug portion attachment section 304 is disposed upon the ratchet attachment end of the size adapting body 302. The ratchet plug portion attachment section 304 enables attachment of the drive size-adjusting adaptor 300 to the socket attachment receptacle 122 of the female interfacing drive ratchet 100. A ratchet locking bearing 308 can be integrated into one of the exterior side surfaces of the ratchet plug portion attachment section 304 for securing the drive size adjusting adaptor 300 into the socket attachment receptacle 122 of the female interfacing drive ratchet 100. A socket receptacle driver adapter 340 is similar to the socket receptacle reducer 290, including an adapting drive receiving section 344 provided within an adapting body 342. The adapting drive receiving section 344 is preferably a ¼" hex shaped female receiving section for receiving a tool bit attaching section 349 of a tool bit 348. A ratchet locking bearing 346 is disposed upon the ratchet-attaching end of the socket receptacle driver adapter 340, for attaching the socket receptacle driver adapter 340 to the socket attachment receptacle 122 of the female interfacing drive ratchet 100. The socket receptacle driver adapter 340 and receptacle-based drive ratchet 100 result in a tool having a greatly reduced height requirement between a tip of the tool bit 348 and the back of the ratchet head 104.

Figure 22:
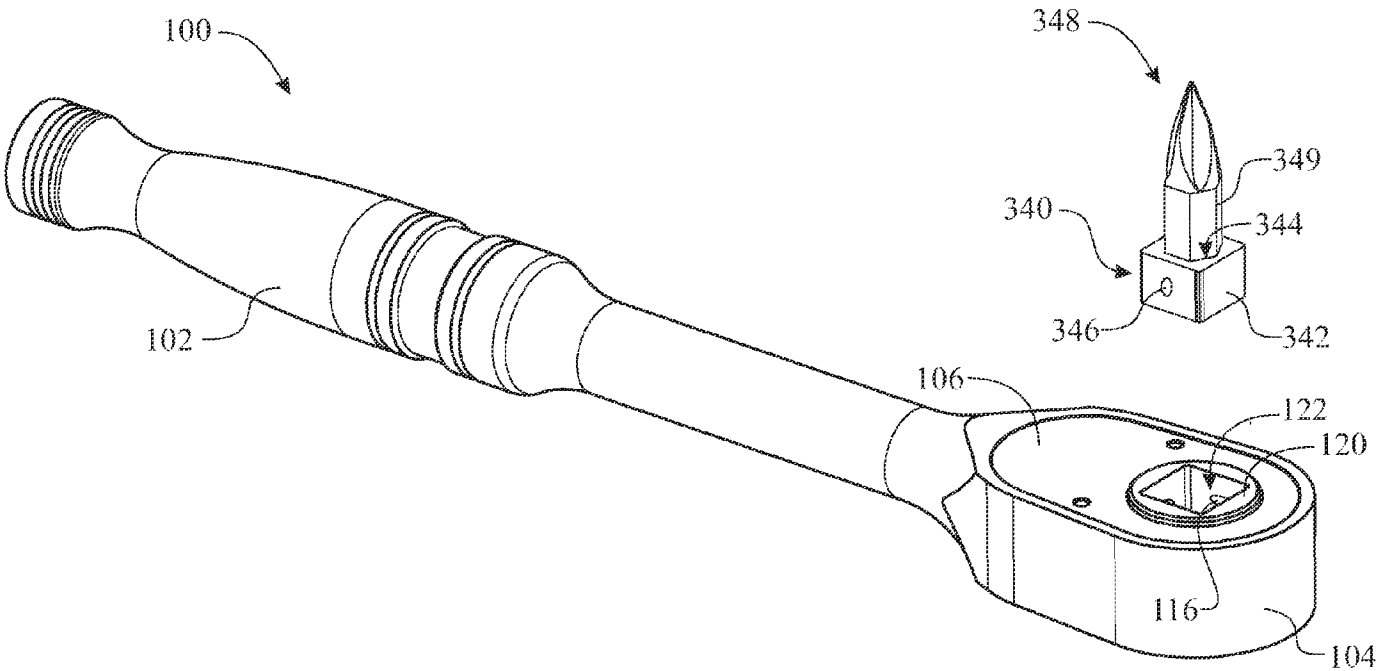
FIG. 22 presents an isometric view of a common hexagonal interface tool bit engaged with an adapting body for adapting the tool bit body to the socket attachment receptacle of the receptacle-based socket attaching interface ratchet wrench of FIG. 1.

A hexagonal based drive bit 348 adapted to a receptacle-based drive ratchet 100, using a hexagonal to square receptacle driver adapter 340, is presented in FIG. 22. A hexagonal-to-square receptacle driver adapter 340 is provided having a square outer peripheral shaped adapting body 342. A hexagonally-shaped adapting drive receiving section 344 is provided within the center of the hexagonal-to-square receptacle driver adapter 340. The hexagonal-based drive bit 348 incorporates a tool bit hexagonal attaching section 349. The tool bit hexagonal attaching section 349 is inserted into the adapting drive receiving section 344. The hexagonal to square receptacle driver adapter 340 is inserted into the socket attachment receptacle 122 of the receptacle-based drive ratchet 100, and secured by engagement of a ratchet locking bearing 346 with the locking bearing receiving detent 116.

Figure 23:
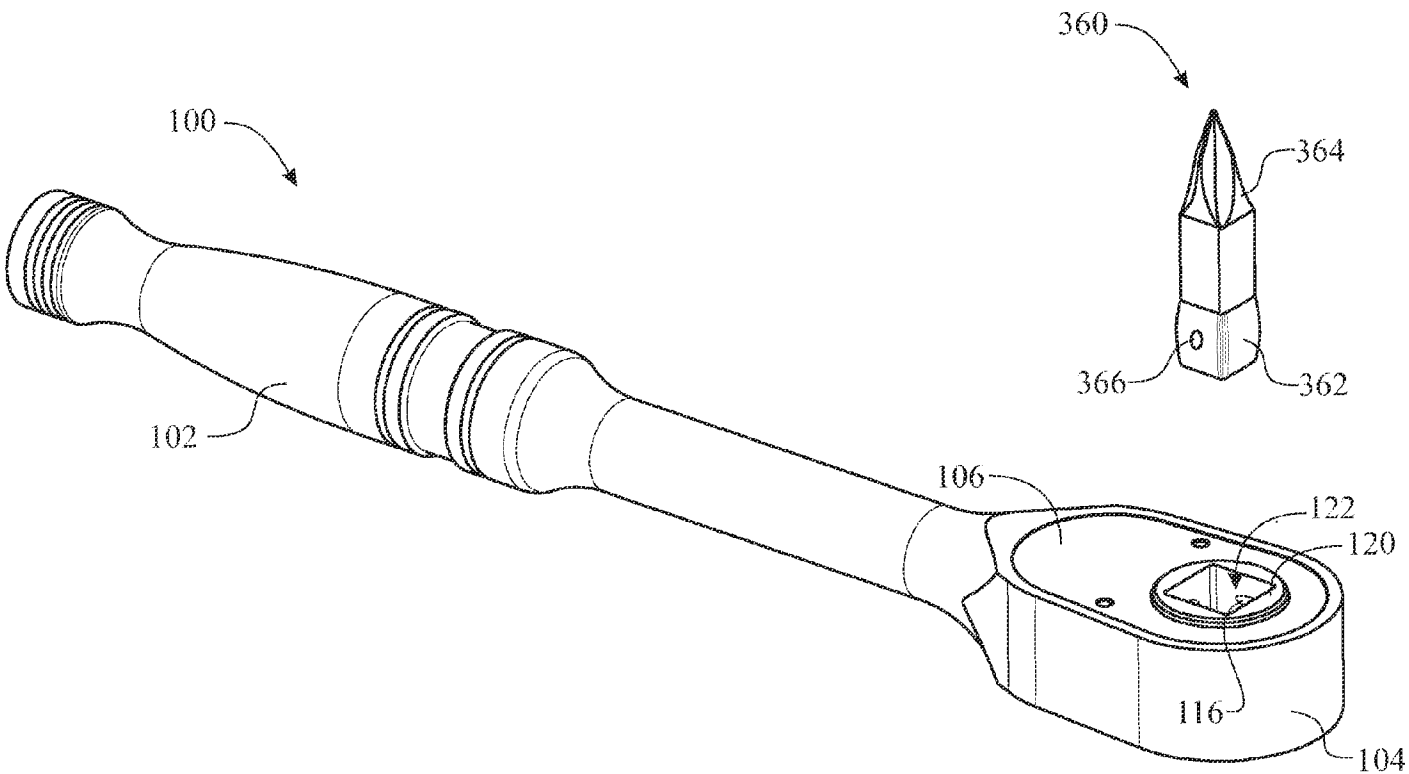
FIG. 23 presents an isometric view of a common square interface tool bit further comprising a wobble engaging section for interfacing with the socket attachment receptacle of the receptacle-based socket attaching interface ratchet wrench of FIG. 1.

A wobble tool bit 360 includes a tool bit 364 that engages a fastener, and a wobble interface 362 that provides a wobble motion when the wobble interface 362 is inserted into the socket attachment receptacle 122 of the receptacle-based drive ratchet 100, as presented in FIG. 23. The wobble tool bit 360 is secured within the socket attachment receptacle 122 by a ratchet locking bearing 366 engaging the locking bearing receiving detent 116.

Figure 24:
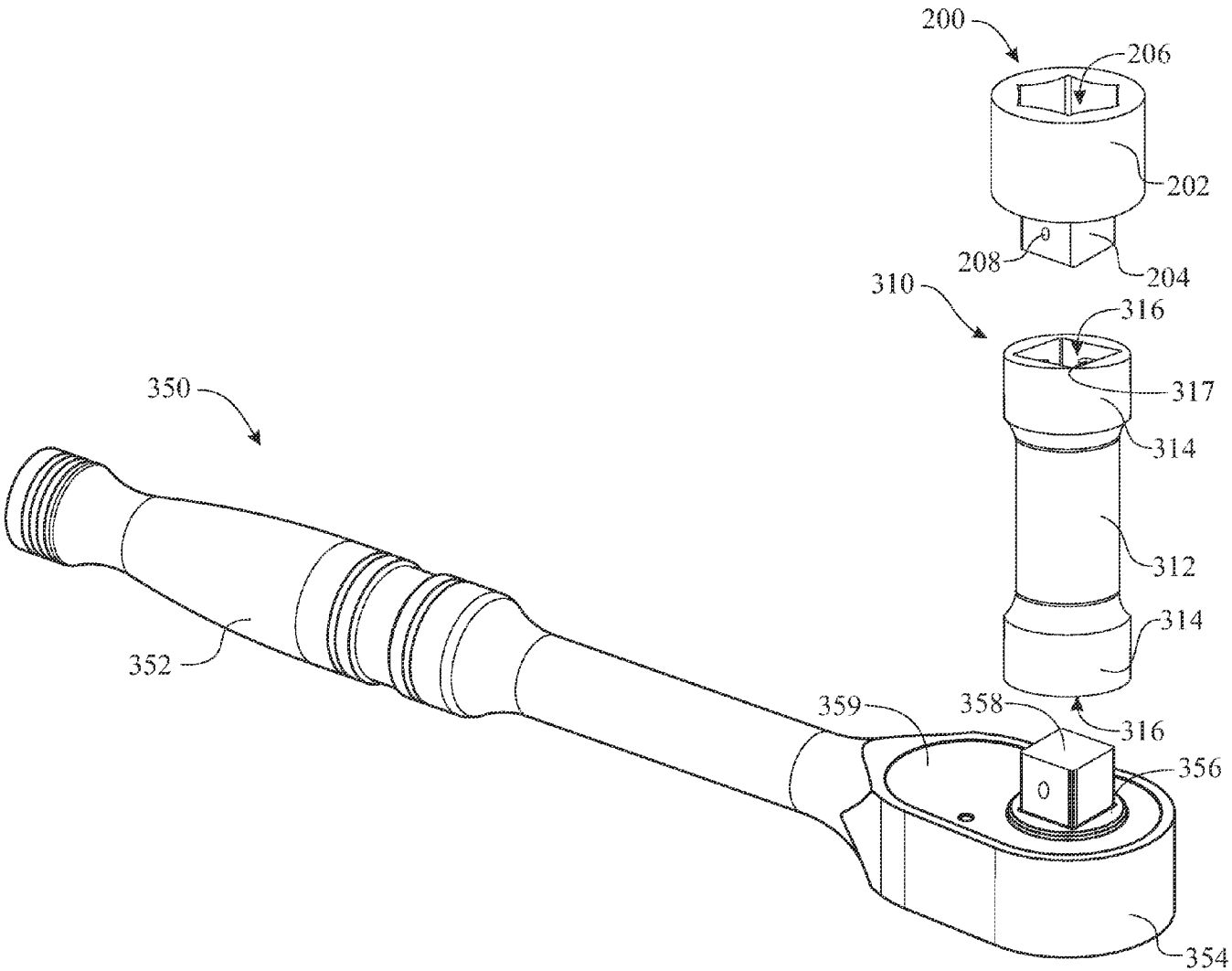
FIG. 24 presents an isometric view of a standard plug-based socket attaching interface ratchet wrench, the illustration further presenting a standard plug-based socket interface to a receptacle-based adapter and extension and respective male portion attaching interface socket.

Referring now to FIG. 24, a plug-based to receptacle-based extension and converter 310 provides an adapter between a standard plug-based drive ratchet 350 and the plug-based drive socket 200. The standard plug-based drive ratchet 350 has a standard drive handle section 352 and a plug-based ratchet head section 354. The standard drive handle section 352 provides leverage for securing or removing a threaded fastener. The plug-based ratchet head section 354 provides a ratchet wrench interface to a socket or other driver tool. The plug-based ratchet head section 354 includes a plug-based drive gear 356 having a plug-based drive attaching section 358 for receiving a socket connecting receptacle 316 of a plug-based to receptacle-based extension and converter 310. Although the illustration presents a plug-based to receptacle-based extension and converter 310 as the exemplary attachment to the standard plug-based drive ratchet 350, it is understood the standard plug-based drive ratchet 350 is the currently available socket wrench and any tool (such as standard receptacle-based socket 210 of FIG. 9) can be attached to the standard plug-based drive ratchet 350. The illustration presents the standard plug-based drive ratchet 350 including an extension body 312 having a receptacle-based drive attachment body 314 disposed at the ratchet-attaching end, and a receptacle-based drive attaching body 314 disposed at the socket-attaching end. A socket connecting receptacle 316 is provided within the receptacle-based drive attaching body 314 for coupling to the plug-based drive attaching section 358 of the standard plug-based drive ratchet 350. A socket-connecting receptacle 316 is provided within the receptacle-based drive attaching body 314 for coupling to the plug drive section 204 of the plug-based drive socket 200. A set of four locking bearing receiving detents 317 can be provided within the inner wall surfaces of the socket connecting receptacle 316 for receiving the ratchet locking bearing 208. The gear drive assembly is held within the plug-based ratchet head section 354 via a drive gear cover 359.

Figure 25:
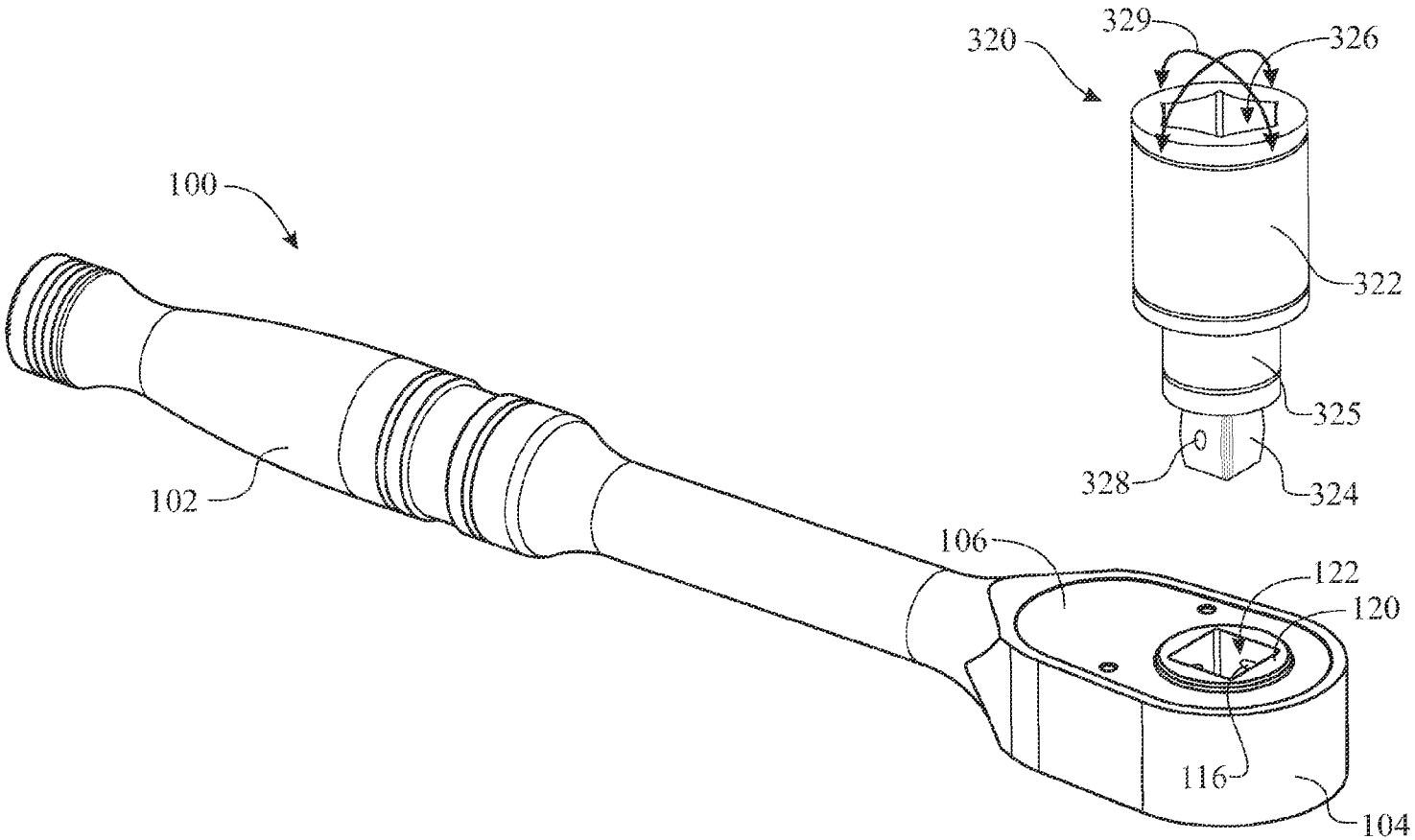
FIG. 25 presents an isometric view of the receptacle-based socket attaching interface ratchet wrench of FIG. 1, the illustration further presenting a wobble plug attaching portion interface socket.
Figure 26:
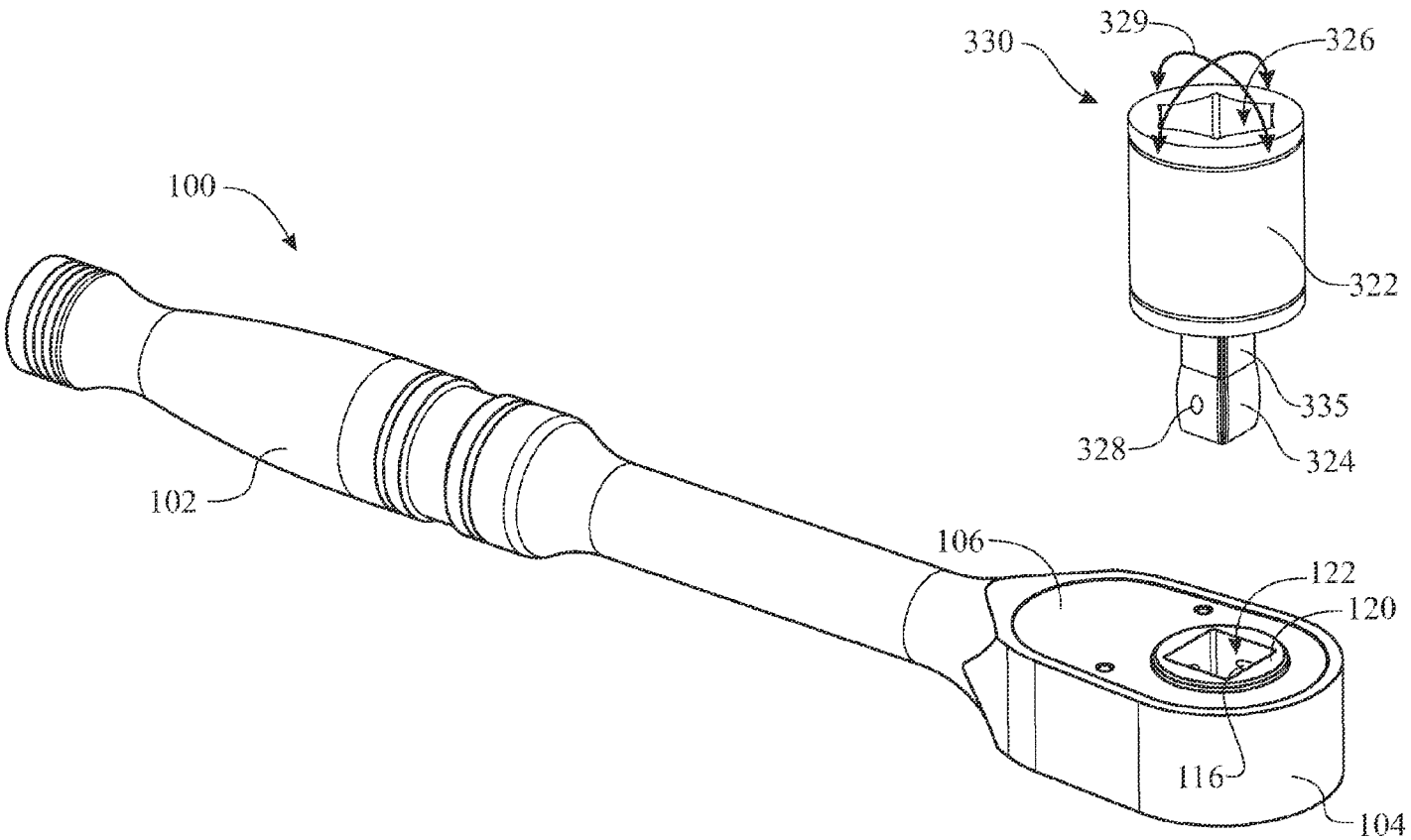
FIG. 26 presents an isometric view of the receptacle-based socket attaching interface ratchet wrench of FIG. 1, the illustration further presenting an alternate wobble male portion attaching interface socket.
Figure 27:
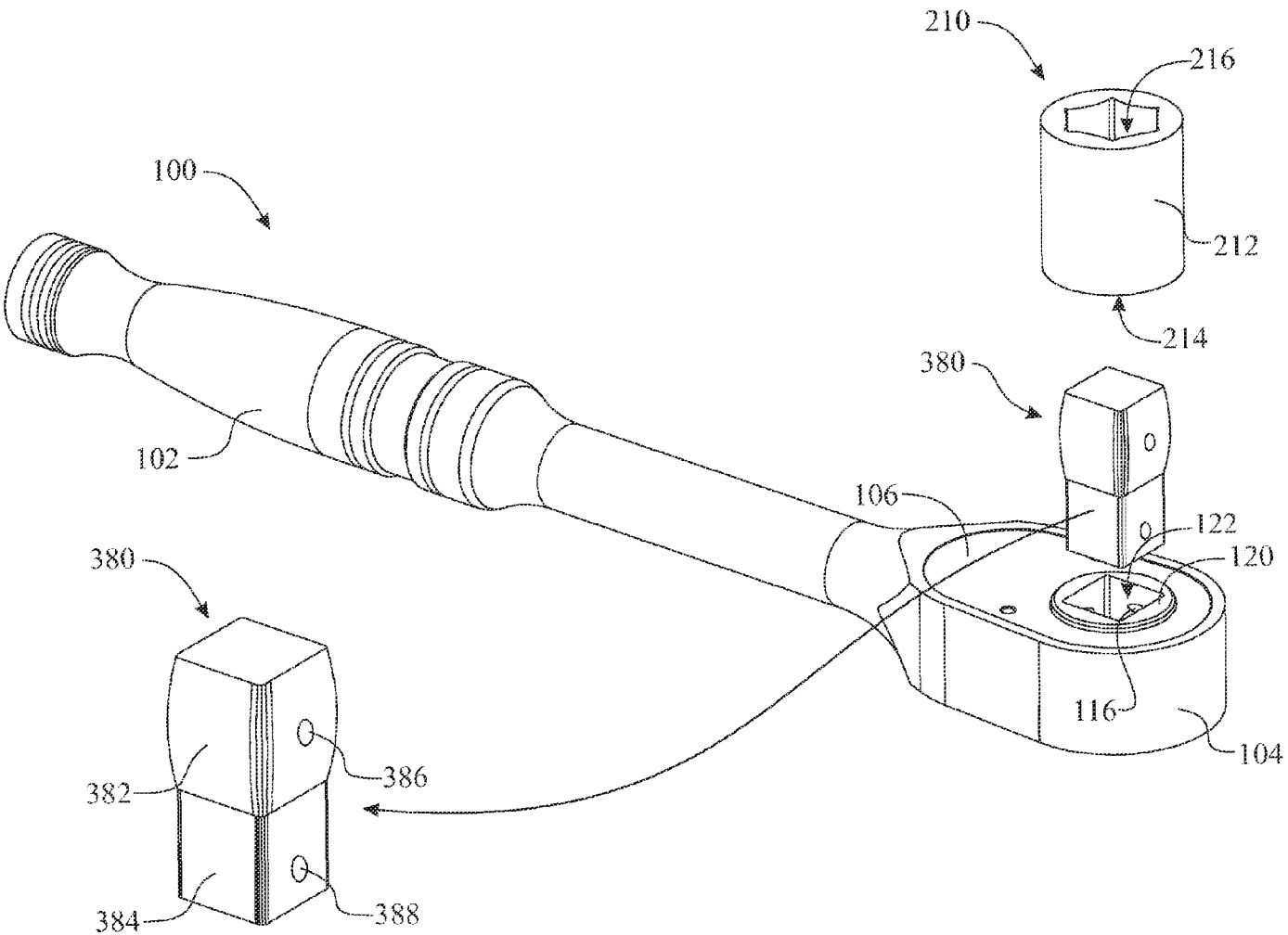
FIG. 27 presents an isometric view of the receptacle-based socket attaching interface ratchet wrench of FIG. 1, the illustration further presenting a wobble adapter.

Three examples of wobble attaching sockets designs are presented. A wobble plug attachment portion socket 320 and a wobble plug attachment portion socket 330 are shown in FIGS. 25-27. The wobble plug attachment portion socket 320 (FIG. 25) includes a socket body 322 having a socket connecting receptacle 326 provided therein. A wobble drive plug attaching section 324 is disposed at a ratchet-attaching end of the socket body 322. The wobble drive plug attaching section 324 has four sidewalls that are partially curved, causing the aforementioned wobble motion 329. A wobble spacing section 325 is placed between the wobble drive plug attaching section 324 and the socket body 322, as a means for reducing the diameter of the socket body 322 proximate the wobble drive plug attaching section 324. If the diameter of the socket body 322 were too wide, the diameter would hinder the wobbling motion 329 of the wobble plug attach mention portion socket 320; hence, the inclusion of the wobble spacing section 325. A wobble plug attachment portion socket 330 (FIG. 26) includes the general features of the wobble plug attachment portion socket 320, utilizing a square wobble spacing section 335 disposed between the wobble drive plug attaching section 324 and the socket body 322. It is also recognized the wobble spacing section 325 and the wobble spacing section 335 can be removably coupled to the socket body 332, thereby providing a wobble adapter with an optional extension. The wobble spacing section 325 can include a female attachment configuration similar to the receptacle-based attaching body 284, for coupling to a socket connecting receptacle 214 of a standard receptacle-based socket 210. The wobble spacing section 335 can include a male attachment configuration similar to the socket plug portion attachment section 276, for coupling to a plug drive section 204 of a plug-based drive socket 200. Additionally, a ratchet locking bearing 328 can be assembled to one of the edges of the wobble drive plug attaching section 324 to engage the locking bearing receiving detent 116 and secure the wobble drive plug attaching section 324 within the socket attachment receptacle 122. This gives the user the capability of utilizing a wobble adapter 380 in conjunction with the receptacle-based drive ratchet 100. Another advantage of the wobble adapter 380 lies in the configuration, which allows the user to place the wobble feature at either the ratchet interface or the socket interface by simply inverting the wobble adapter 380. The wobble adapter 380 includes an adapter plug portion attachment section 384, which can be removably inserted into the socket attachment receptacle 122 of the receptacle-based drive ratchet 100. A ratchet locking bearing 388 engages the locking bearing receiving detent 116, securing the wobble adapter 380 within the socket attachment receptacle 122 of the receptacle-based drive ratchet 100. A wobble plug socket interface section 382 is disposed on the opposite end of the wobble adapter 380. The wobble plug socket interface section 382 has the same shape as the wobble drive plug attaching section 324 previously presented. A socket locking bearing 386 is assembled to the wobble plug socket interface section 382 for securing with the standard receptacle-based socket 210.

Figure 28:
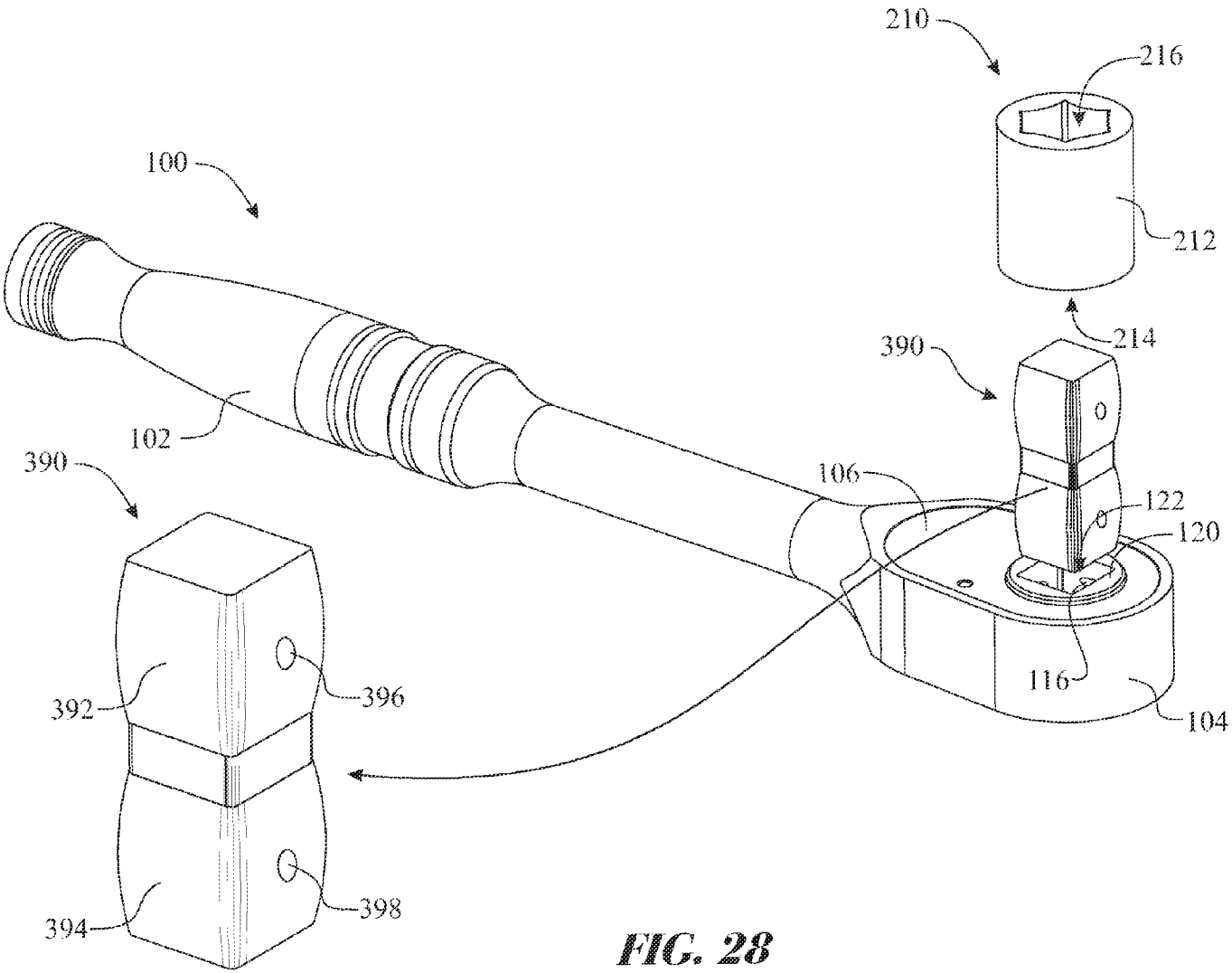
FIG. 28 presents an isometric view of the receptacle-based socket attaching interface ratchet wrench of FIG. 1, the illustration further presenting a wobble receptacle-based to standard wobble interface based converter and respective standard ratchet wrench interface socket.

A dual wobble adapter 390 is presented in FIG. 28. The dual wobble adapter 390 (FIG. 14) includes a wobble plug socket interface section 392 on a first end, and an adapter plug portion attachment section 394 on an opposite end. The dual wobble adapter 390 enables a user to employ the standard receptacle-based socket 210 in conjunction with the female interfacing drive ratchet 100. Each end of the dual wobble adapter 390 is has arched, or arcuate, sidewalls that provide a wobble between the dual wobble adapter 390 and each engaging member—such as the receptacle-based drive ratchet 100 and the standard receptacle-based socket 210. Socket locking bearings 396, 398 are assembled to each of the wobble plug socket interface sections 392, 394. The socket locking bearings 396, 398 are provided for securing the dual wobble adapter 390 to each engaging member. The adapter plug portion attachment section 394 is inserted into the socket attachment receptacle 122, engaging the ratchet locking bearing 398 with the locking bearing receiving detent 116. The wobble plug socket interface section 392 is inserted into the socket connecting receptacle 214 of the standard receptacle-based socket 210, and secured via the socket locking bearing 396 into a recess similar to the locking bearing receiving detent 116 of the receptacle-based drive gear 120.

Figure 29:
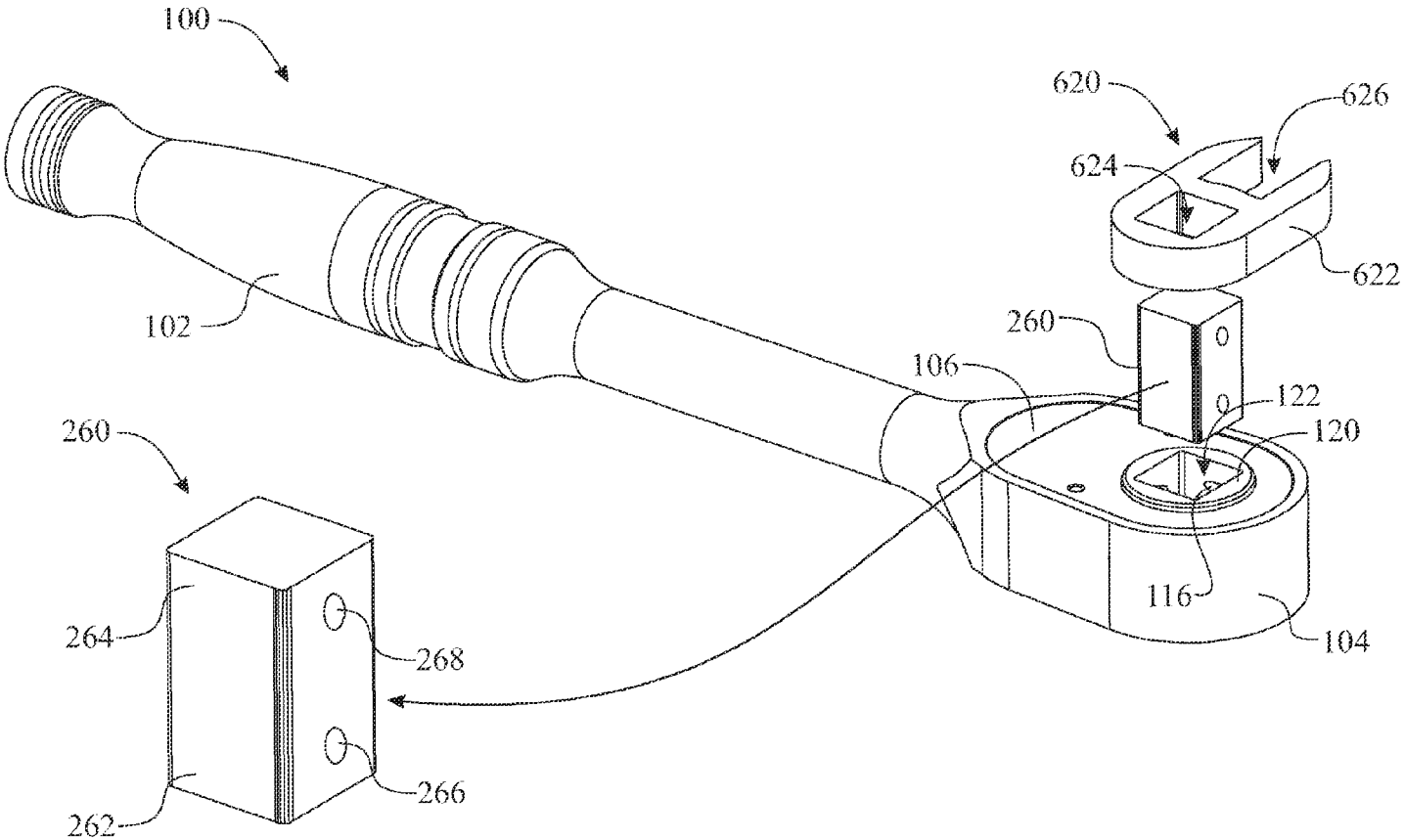
FIG. 29 presents an isometric view of the receptacle-based socket attaching interface ratchet wrench of FIG. 1, the illustration further presenting a receptacle-based to standard interface based converter, introducing a crows foot or box end tool.
Figure 30:
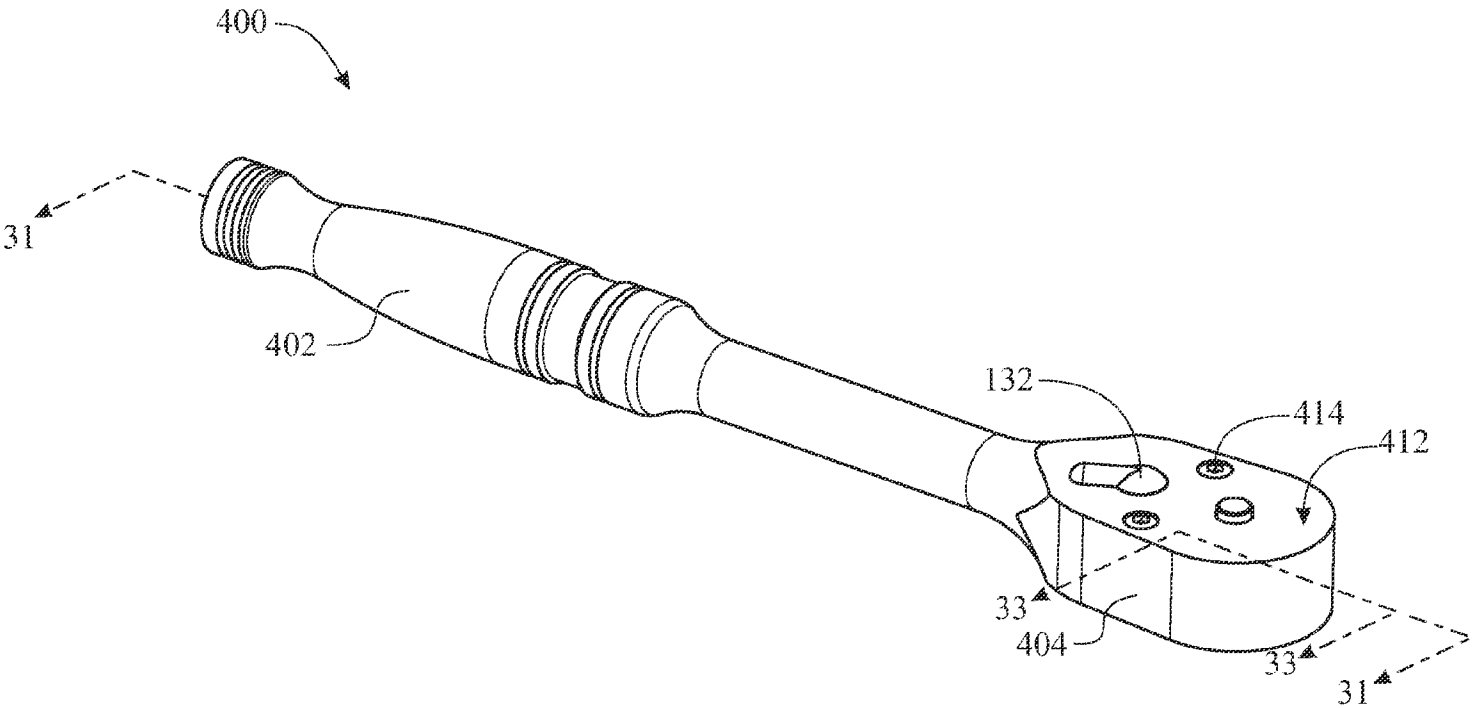
FIG. 30 presents an isometric bottom view of the receptacle-based socket attaching interface ratchet wrench, the wrench further comprising a socket ejection member.
Figure 31:
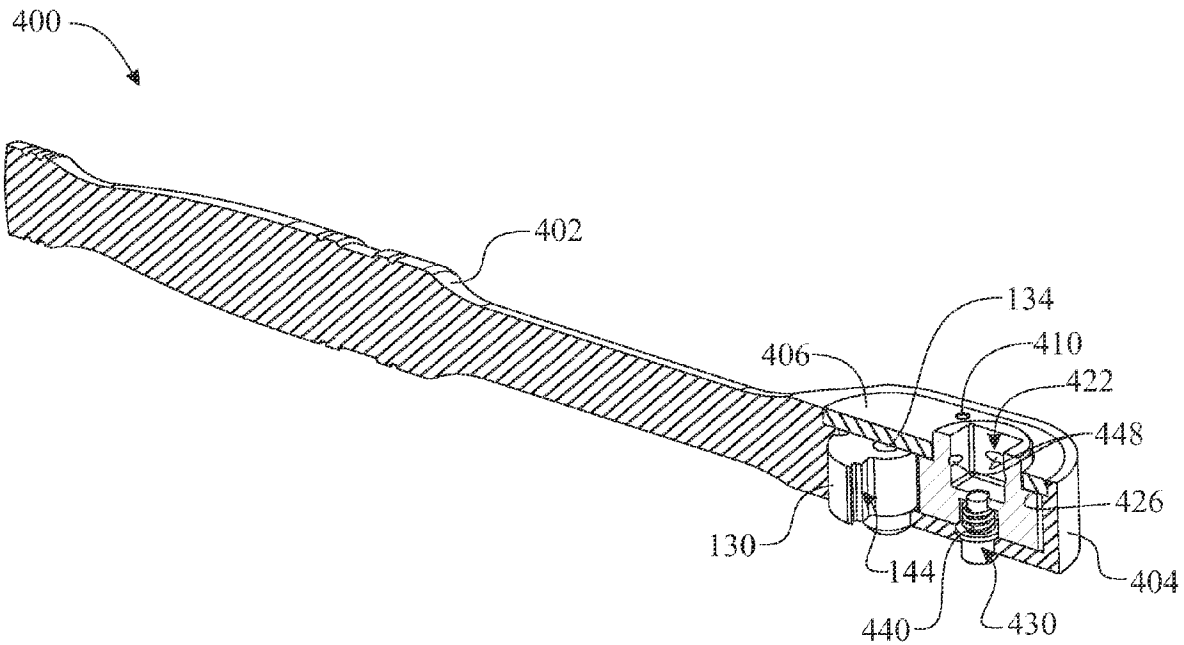
FIG. 31 is an isometric sectional view of the receptacle-based attaching interface ratchet wrench taken along section 31-31 of FIG. 30, wherein section 31-31 is a longitudinal center line along the wrench body to illustrate the socket ejection member installation.

A box end drive 620 is introduced in FIG. 29. The box end drive 620 is shaped having a box end drive body 622 with a socket connecting receptacle 624 disposed therethrough, and a box engaging tool section 626 for engaging a fastening device such as a nut, bolt, and the like. The box end drive 620 is placed in mechanical communication with the receptacle-based drive ratchet 100 via the receptacle-based to plug-based drive converter 260. The socket plug portion attachment section 264 is inserted into the socket connecting receptacle 624, with the socket locking bearing 268 engaging a recess similar to the locking bearing receiving detent 116 of the receptacle-based drive gear 120.

A socket release assisting drive 400 having a socket ejection system is presented in FIGS. 30-34. The socket release assisting drive 400 has a socket ratchet handle section 402 and a ratchet head section 404. The socket ratchet handle section 402 provides leverage for attaching or removing a threaded fastener. The ratchet head section 404 provides a ratchet wrench interface to a socket or other driver tool. The ratchet head section 404 includes a receptacle-based drive gear 420 having a socket connecting receptacle 422 for receiving the plug drive section 204 of the plug-based drive socket 200. A locking bearing receiving detent 448 is provided within each of the four walls of the socket-connecting receptacle 422. The drive head is assembled in a manner similar to the ratchet drive section assembly 105 previously presented. The receptacle-based drive gear 420 is assembled within the ratchet drive section 104 engaging the drive gear directional control 130. The drive gear directional control 130 pivots via a drive gear directional control lever 132 and a directional control lever shaft 134, to selectively engage either counterclockwise drive teeth 144 or clockwise drive teeth 148 (see FIG. 3) to a series of drive gear teeth 424 disposed about a circumference of the receptacle-based drive gear 120. The drive gear directional control 130 provides a ratcheting motion to the receptacle-based drive gear 420 via the series of drive gear teeth 424. The ratcheting motion is provided in a manner consistent with that which was presented in FIGS. 1-5.

Figure 32:
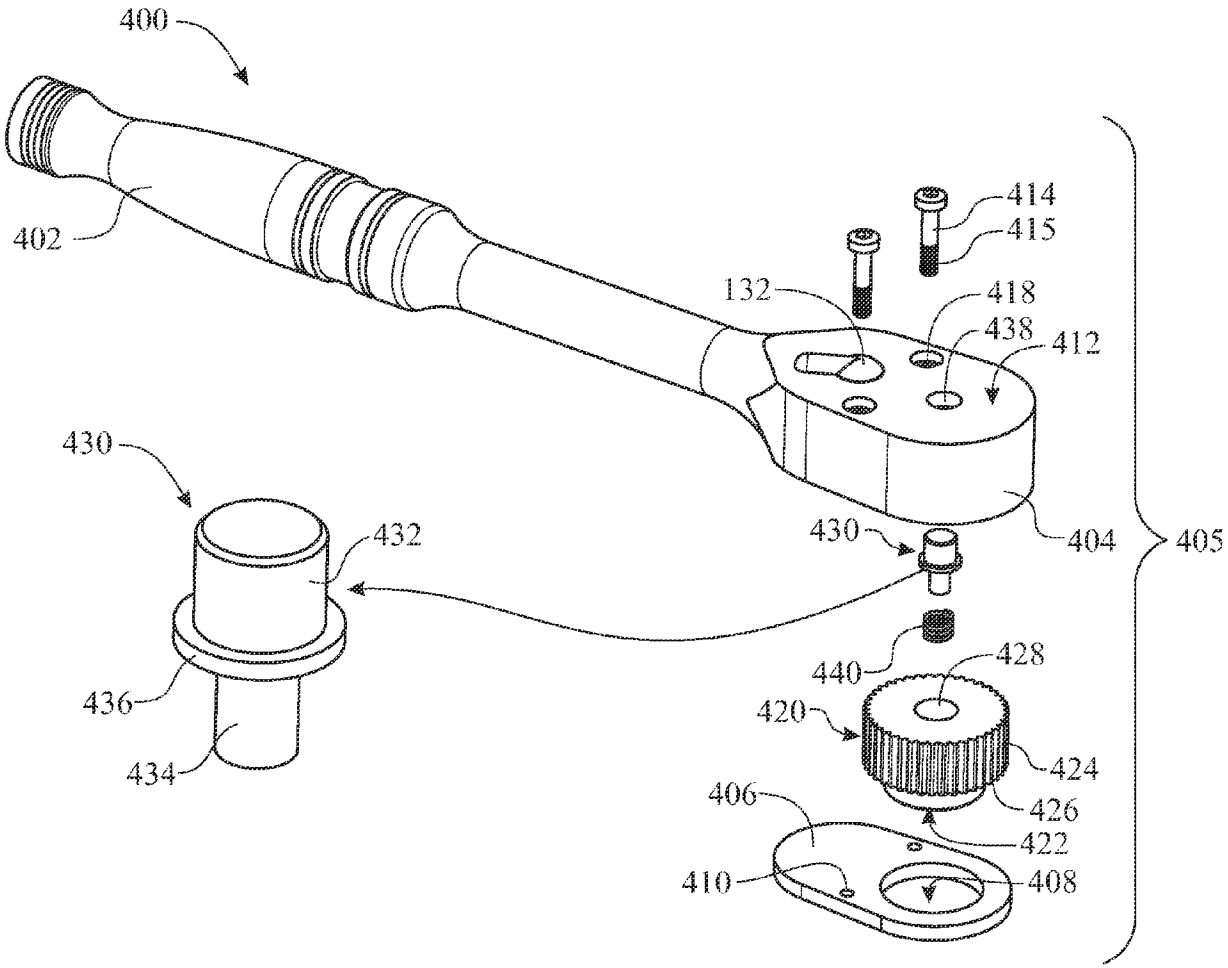
FIG. 32 is an isometric view of the receptacle-based socket attaching interface ratchet wrench of FIG. 30 illustrating an exploded view of the ratchet wrench head section assembly.
Figure 33:
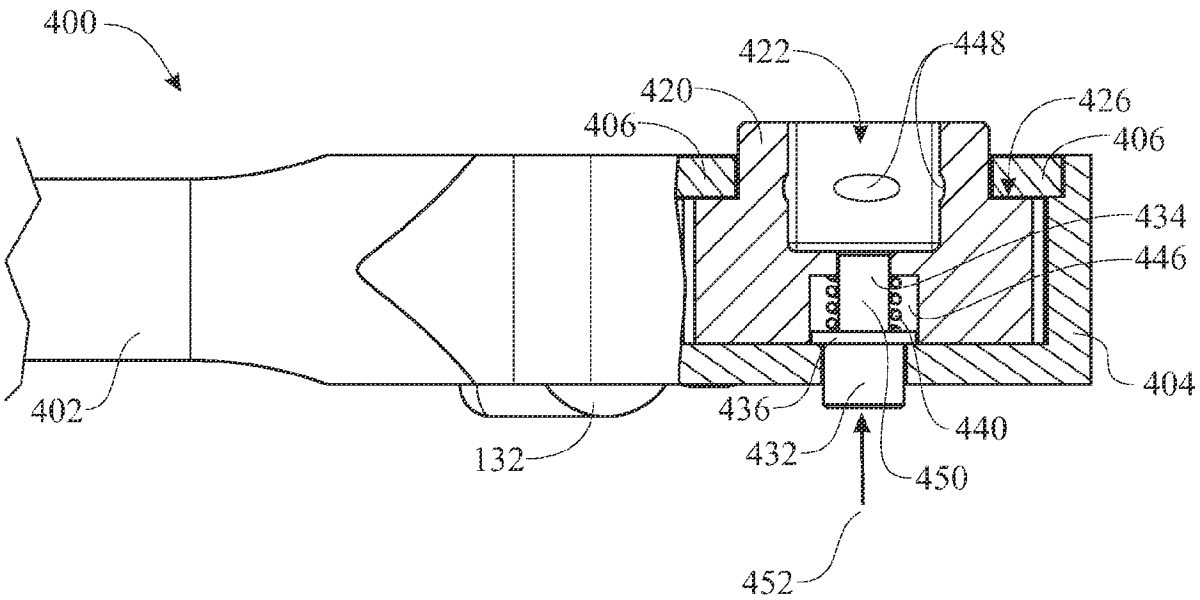
FIG. 33 is a sectional side view of the receptacle-based socket attaching interface ratchet wrench taken along section 33-33 of FIG. 30, wherein section 33-33, illustrates the socket releasing ratchet wrench head section assembly.

The receptacle-based drive gear 420 and drive gear directional control 130 are contained within the ratchet head section 404 via a gear assembly cover plate 406. The gear assembly cover plate 406 is secured to the ratchet head section 404 via a pair of cover plate fasteners 414. The cover plate fasteners 414 are inserted from a ratchet head back section 412 of the ratchet drive section 104, through a body fastener sleeve 418, and secured by threading the fastener threading 415 into a gear assembly cover plate fastening threads 410 of the gear assembly cover plate 406. The receptacle-based drive gear 420 is secured within the ratchet head section 404 via a drive gear assembly shoulder 426, which contacts an interior face of the gear assembly cover plate 406. The socket connecting receptacle 422 section projects through a drive gear port 408 of the gear assembly cover plate 406. Details of the components are illustrated in connection with a ratchet head assembly 405 (FIG. 32). The complete ratcheting assembly is presented in a side cross-sectional view in FIG. 33.

Figure 34:
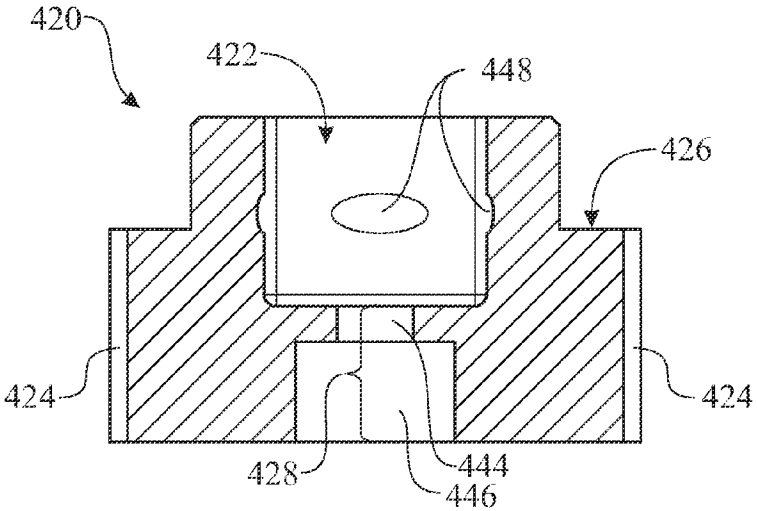
FIG. 34 is a sectional side view of the receptacle-based socket attaching interface drive gear.

Details of the receptacle-based drive gear 420 are presented in a side cross-sectional view of FIG. 34. The receptacle-based drive gear 420 incorporates a release pin port 428 having two sections: an ejector sleeve 444 and a collar sleeve 446. The release pin port 428 provides a port for the actuation of a socket ejecting member 430. The socket ejecting member 430 is assembled within the collar sleeve 446 of the receptacle-based drive gear 420, placing a release member collar 436 against an inner wall of the ratchet head back section 412 and inserting a release member actuating button 432 of the socket ejecting member 430 through an ejector actuating button port 438 of the ratchet head back section 412. An ejector spring 440 is placed over the release member socket ejector 434, confined between the release member collar 436 and an inner ledge of the collar sleeve 446 to apply a normal positioning force 450 to the socket ejecting member 430. The user applies an ejection activating force 452 to the release member actuating button 432, causing the socket ejecting member 430 to move inward, thereby ejecting the plug drive section 204 (of FIG. 1).

Figure 35:
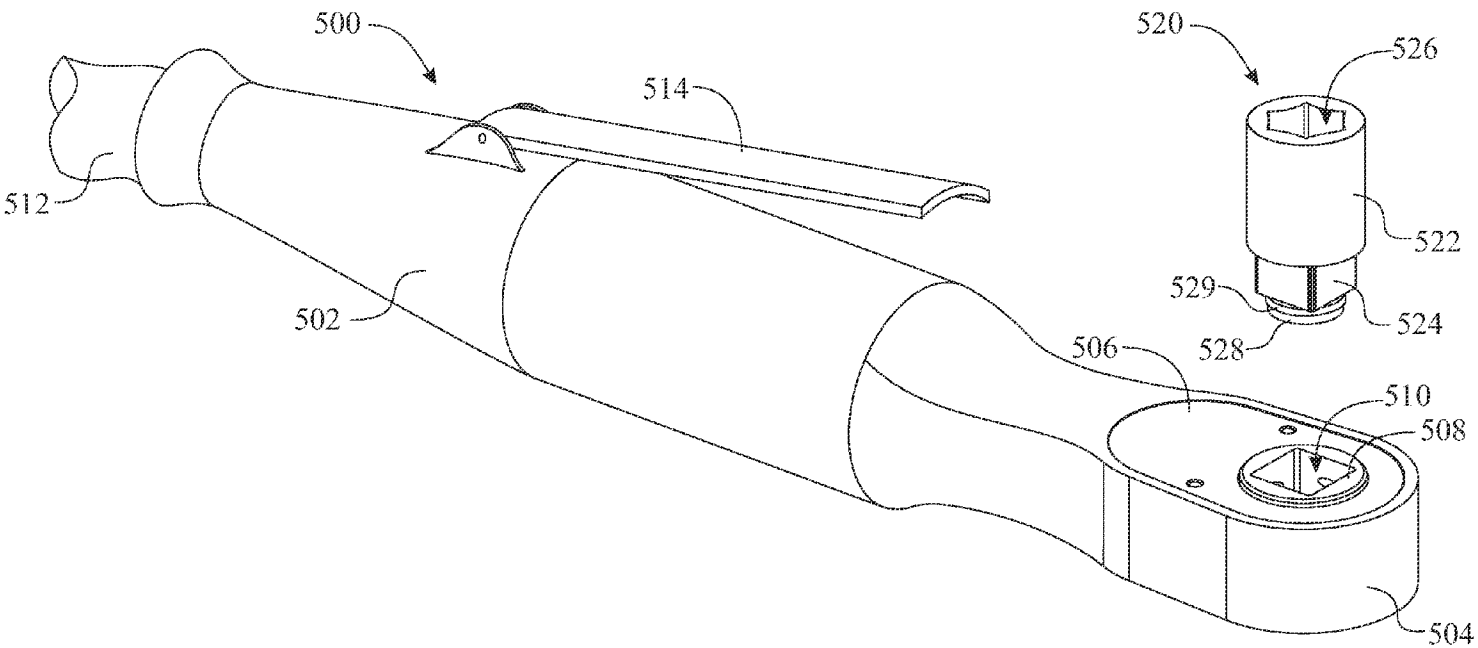
FIG. 35 is an isometric view of an air or electric impact wrench having a receptacle-based socket attaching interface.

Referring now to FIG. 35, another embodiment of the present invention is an air driven ratchet driver 500. The air driven ratchet driver 500 generally includes the features of a pneumatic air wrench or impact wrench. The air driven ratchet driver 500 is divided into two subsections: an air driven ratchet driver body 502 and an air driven ratchet driver head 504. The air driven ratchet driver body 502 includes an air conduit (not shown but understood), wherein airflow is provided via a compressed air delivery conduit 512 and controlled via an airflow control 514. The air driven ratchet driver head 504 includes a female drive gear 508 having a socket-connecting receptacle 510 for receiving an air wrench plug drive section 524 of an air wrench socket 520 or other impact driver tool. The air wrench socket 520 includes a socket body 522 having a fastener head receiving section 526 or other tool head. The air wrench plug drive section 524 includes a locking split snap ring 529 assembled to a snap ring shaft 528. The receptacle-based drive gear 508 and other drive components are contained within the air driven ratchet driver head 504 via a gear assembly cover plate 506.

Figure 4:
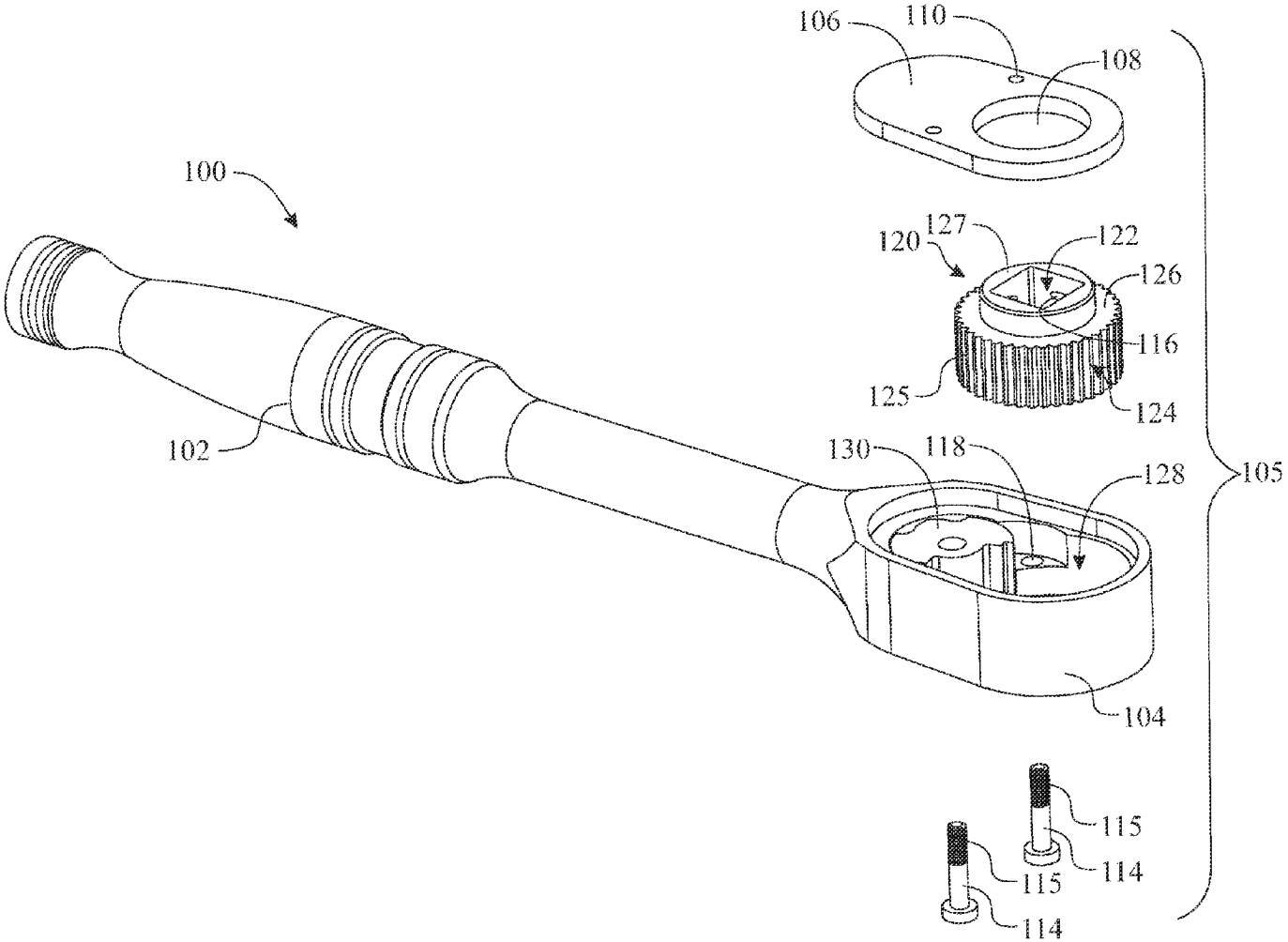
FIG. 4 presents an isometric, exploded top view of the receptacle drive ratchet wrench as presented in FIG. 1 illustrating the various components of a head assembly.
Figure 36:
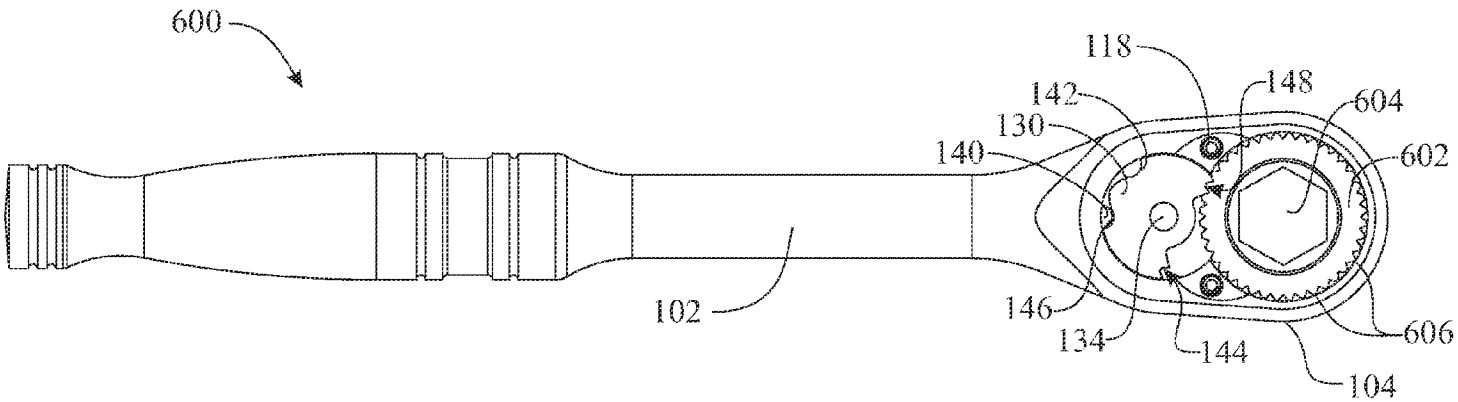
FIG. 36 presents a top view of an alternate hexagonally-shaped receptacle drive ratchet wrench with a gear assembly cover plate removed.
Figure 39:
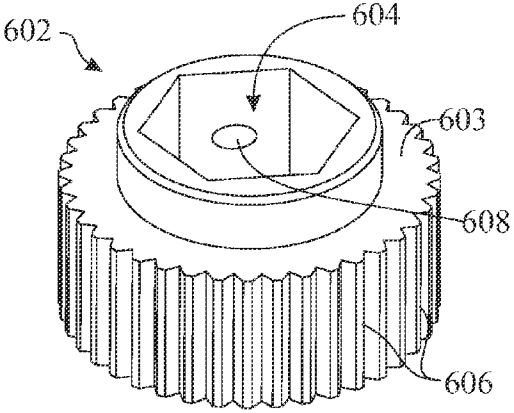
FIG. 39 presents an isometric, top view of the hexagonally-shaped receptacle drive gear of FIG. 37.
Figure 37:
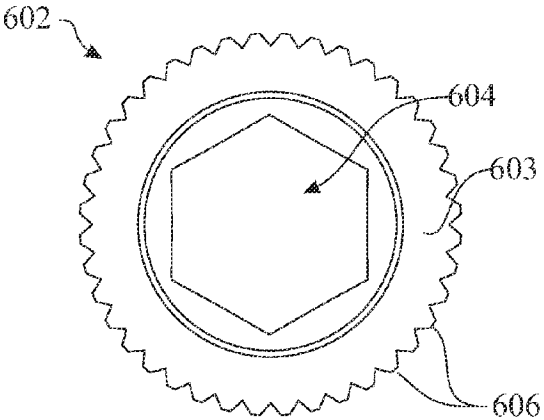
FIG. 37 presents a top view of a hexagonally-shaped receptacle drive gear having a receptacle portion of the socket attaching interface.
Figure 38:
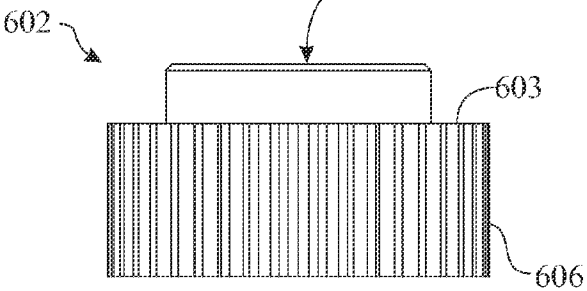
FIG. 38 presents a side view of the hexagonally-shaped receptacle drive gear of FIG. 37.

An alternate shape can be used for the socket attachment receptacle 122, such as a hexagonally-shaped socket attachment receptacle 604 as shown in FIG. 36. The hexagonally-shaped socket attachment receptacle 604 is provided within a receptacle-based drive gear 602. Although the socket attachment receptacle 604 is shown having a hexagonal shape, it is recognized that myriad different shapes can be employed. The receptacle-based drive gear 602 is further illustrated via the three exemplary views in FIGS. 37-39. A top view of receptacle-based drive gear 602 is shown in FIG. 37, a side view in FIG. 38, and an isometric view in FIG. 39. The receptacle-based drive gear 602 includes a hexagonally-shaped socket attachment receptacle 604, which can be provided extending partially or completely through a body of the receptacle-based drive gear 602. The hexagonally-shaped socket attachment receptacle 604 is constructed having six walls, each of which can optionally include a locking bearing receiving detent 608. Drive gear teeth 606 extend about the circumference of the receptacle-based drive gear 602. The receptacle-based drive gear 602 projects from the drive gear assembly shoulder 603, wherein the hexagonally-shaped socket attachment receptacle 604 is assembled projecting beyond the drive gear port 108 (FIG. 4) of the drive gear assembly cover plate 106 (FIG. 4), while the drive gear assembly shoulder 603 remains entrapped behind an inner surface of the drive gear assembly cover plate 106 (FIG. 4).

Figure 41:
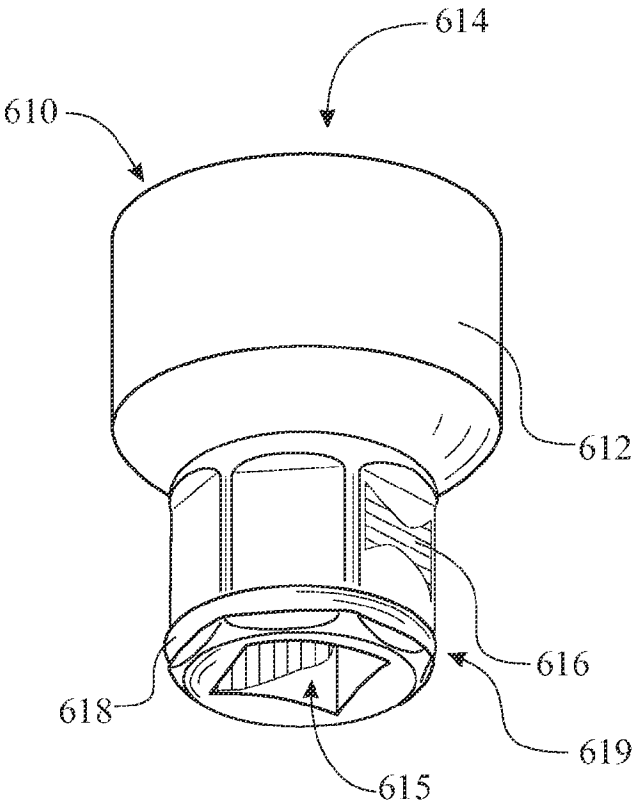
FIG. 41 presents a bottom isometric view of the low profile dual interface socket originally introduced in FIG. 40.
Figure 40:
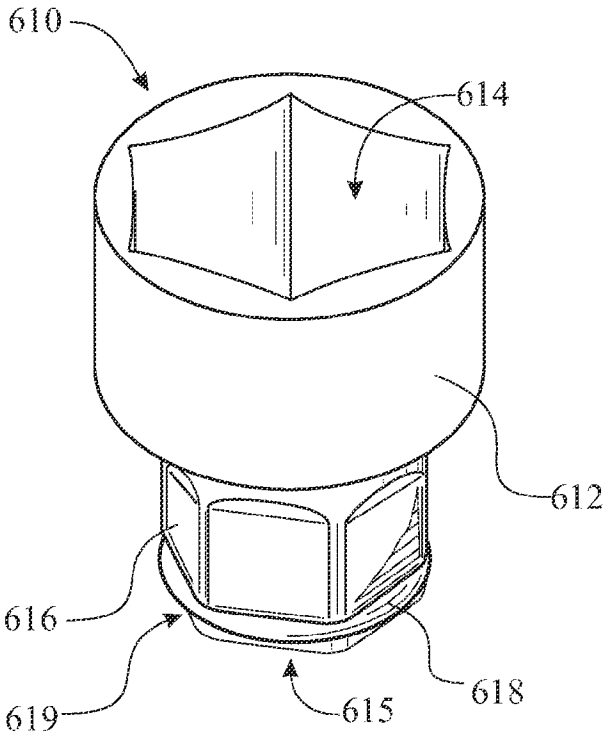
FIG. 40 presents a top isometric view of a low profile dual interface socket.

A dual-socket interface socket 610 is illustrated in FIGS. 40 and 41. The dual socket interface socket 610 essentially utilizes the socket receptacle reducer 290 adapted to the socket, providing engaging features of both the plug-based drive socket 200 and the standard receptacle-based socket 210. The socket 610 includes a common drive such as a fastener head receiving section 614 provided within a socket body 612 and a plug drive section 616 extending axially from a base of the socket body 612 in the opposite direction. The plug drive section 616 can comprise any shape, including hexagonal (as shown), square, and the like. A receptacle drive section 615 is provided within the plug drive section 616, along the same centerline. The receptacle drive section 615 is preferably provided having a square shape for mating with commonly available socket wrenches. A recess similar to the locking bearing receiving detent 116 of the receptacle-based drive gear 120 can be incorporated within the sidewalls that form the receptacle drive section 615. A ratchet locking bearing can be assembled to the plug drive section 616, or an alternate engaging mechanism such as a ratchet locking mechanism 618 as illustrated can be incorporated. The ratchet locking mechanism 618 can be an O-Ring, a metal snap ring, and the like, assembled within a locking mechanism receiving feature 619. These retention mechanisms provide a frictional fit between the plug drive section 616 and the hexagonally-shaped socket attachment receptacle 604, maintaining the tool with in the wrench during use. The dual interface configuration provides the user the ability to utilize the dual socket interface socket 610 in conjunction with a standard plug-based drive ratchet 350 as well as in conjunction with a receptacle-based drive ratchet 600 providing a low profile configuration.

Figure 43:
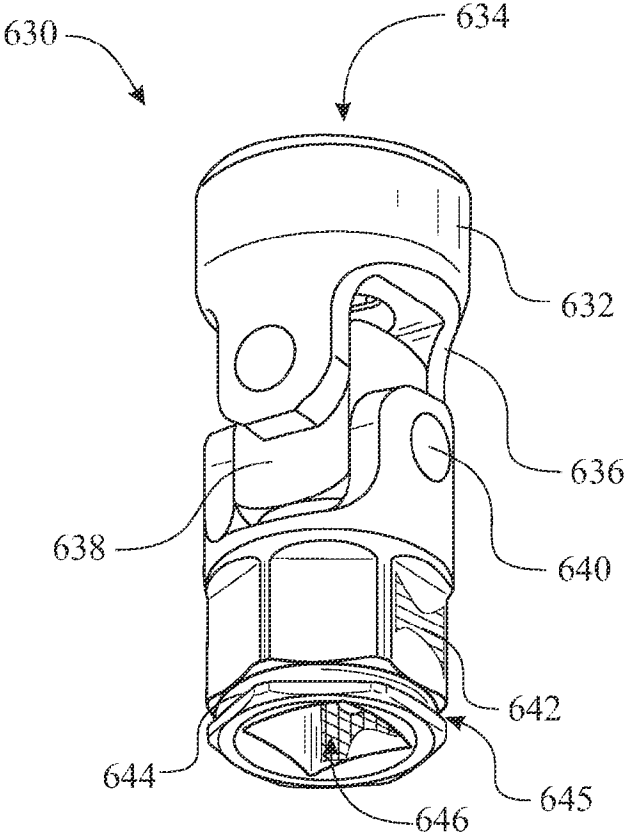
FIG. 43 presents a bottom isometric view of the low profile dual interface universal socket originally introduced in FIG. 42.
Figure 42:
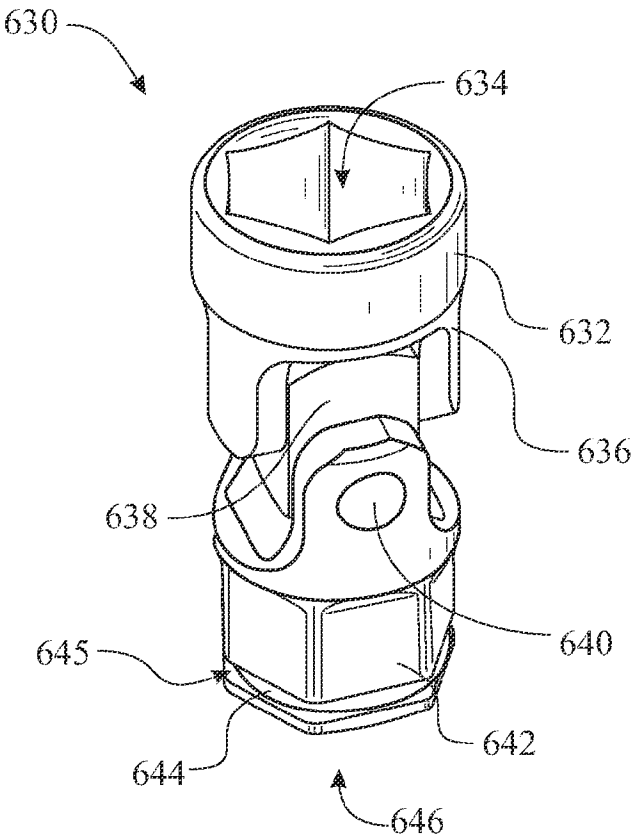
FIG. 42 presents a top isometric view of a low profile dual interface universal socket.

A universal joint socket 630 is best illustrated in FIGS. 42 and 43. The universal joint socket 630 combines the features of a commonly known universal socket with the wrench interface as described above. A tool drive body 632 is universally engaged with a plug drive section 642 via a universal joint. The universal joint comprises a tool drive universal section 636 and a socket adapting universal section 640 joined by an intermediate universal member 638 pivotally disposed therebetween using a series of pins. A fastener head receiving section 634 is provided within the tool drive body 632. The plug drive section 642 is sized and shaped to engage the hexagonally-shaped socket attachment receptacle 604. A locking mechanism receiving feature 645 is provided within the plug drive section 642, creating an assembly area for receiving a ratchet locking mechanism 644. A receptacle drive section 646 is provided within the plug drive section 642, along the same centerline. The receptacle drive section 646 is preferably provided having a square shape for mating with commonly available socket wrenches. A recess similar to the locking bearing receiving detent 116 of the receptacle-based drive gear 120 can be incorporated within the sidewalls that form the receptacle drive section 646. A ratchet locking bearing can be assembled to the plug drive section 642, or an alternative engaging mechanism, such as a ratchet locking mechanism 644 (as shown), can be incorporated. The ratchet locking mechanism 644 can be an O-Ring, a metal snap ring, and the like, assembled within a locking mechanism receiving feature 645. These retention mechanisms provide a frictional fit between the plug drive section 642 and the hexagonally-shaped socket attachment receptacle 604, maintaining the tool within the wrench during use. The dual interface configuration provides the user the ability to utilise the universal joint socket 630 in conjunction with a standard plug-based drive ratchet 350, or in conjunction with a receptacle-based drive ratchet 600, providing a low profile configuration.

Figure 45:
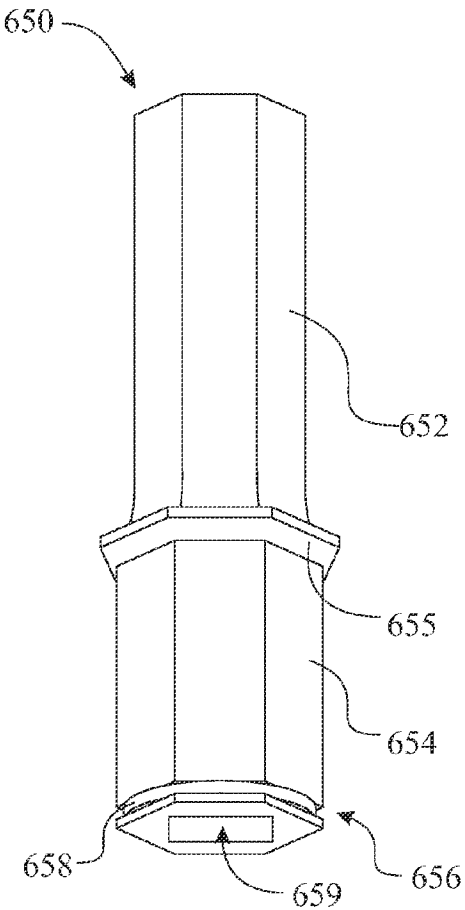
FIG. 45 presents a bottom isometric view of the dual interface hex drive bit originally introduced in FIG. 44.
Figure 44:
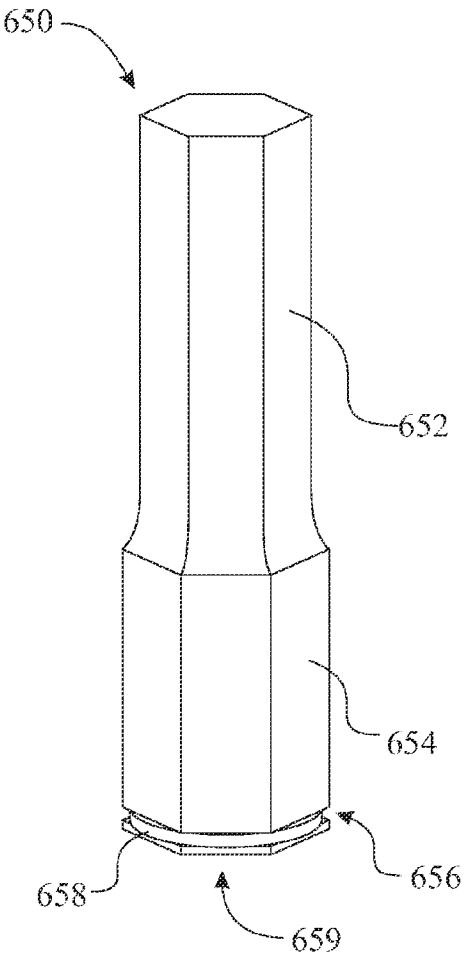
FIG. 44 presents a top isometric view of a dual interface hex drive bit.

A hex tool socket 650 is best illustrated in FIGS. 44 and 45. The hex tool socket 650 combines the features of a commonly known hex drive bit, via a hex tool drive 652, with the wrench interface as described above. The plug drive section 654 is sized and shaped to engage the hexagonally-shaped socket attachment receptacle 604. A locking mechanism receiving feature 656 within the plug drive section 654 provides an assembly area for receiving a ratchet locking mechanism 658. A receptacle drive section 659 is provided within the plug drive section 654, along the same centerline. The receptacle drive section 659 is preferably constructed having a square shape for mating with commonly available socket wrenches. A recess similar to the locking bearing receiving detent 116 of the receptacle-based drive gear 120 can be incorporated within the sidewalls that form the receptacle drive section 659. A ratchet locking bearing can be assembled to the plug drive section 654, or an alternative engaging mechanism, such as a ratchet locking mechanism 658 (as shown), can be incorporated. The ratchet locking mechanism 658 can be an O-Ring, a metal snap ring, and the like, assembled within a locking mechanism receiving feature 656. These retention mechanisms provide a frictional fit between the plug drive section 654 and the hexagonally-shaped socket attachment receptacle 604, maintaining the tool within the wrench during use. Although the hex tool socket 650 presents a hex tool drive 652, it is understood that the tool drive can be of any tool shape, including a TORX bit, a square drive, and screw driver design, and the like. The dual interface configuration provides the user the ability to utilise the hex tool socket 650 in conjunction with a standard plug-based drive ratchet 350, and in conjunction with a receptacle-based drive ratchet 600, providing a low profile configuration. A depth limiting flange 655 can be incorporated about a portion of the plug drive section 654 located distally from the locking mechanism receiving feature 656. The depth limiting flange 655 can be of any peripheral shape to aid in manufacturability and safety.

Figure 46:
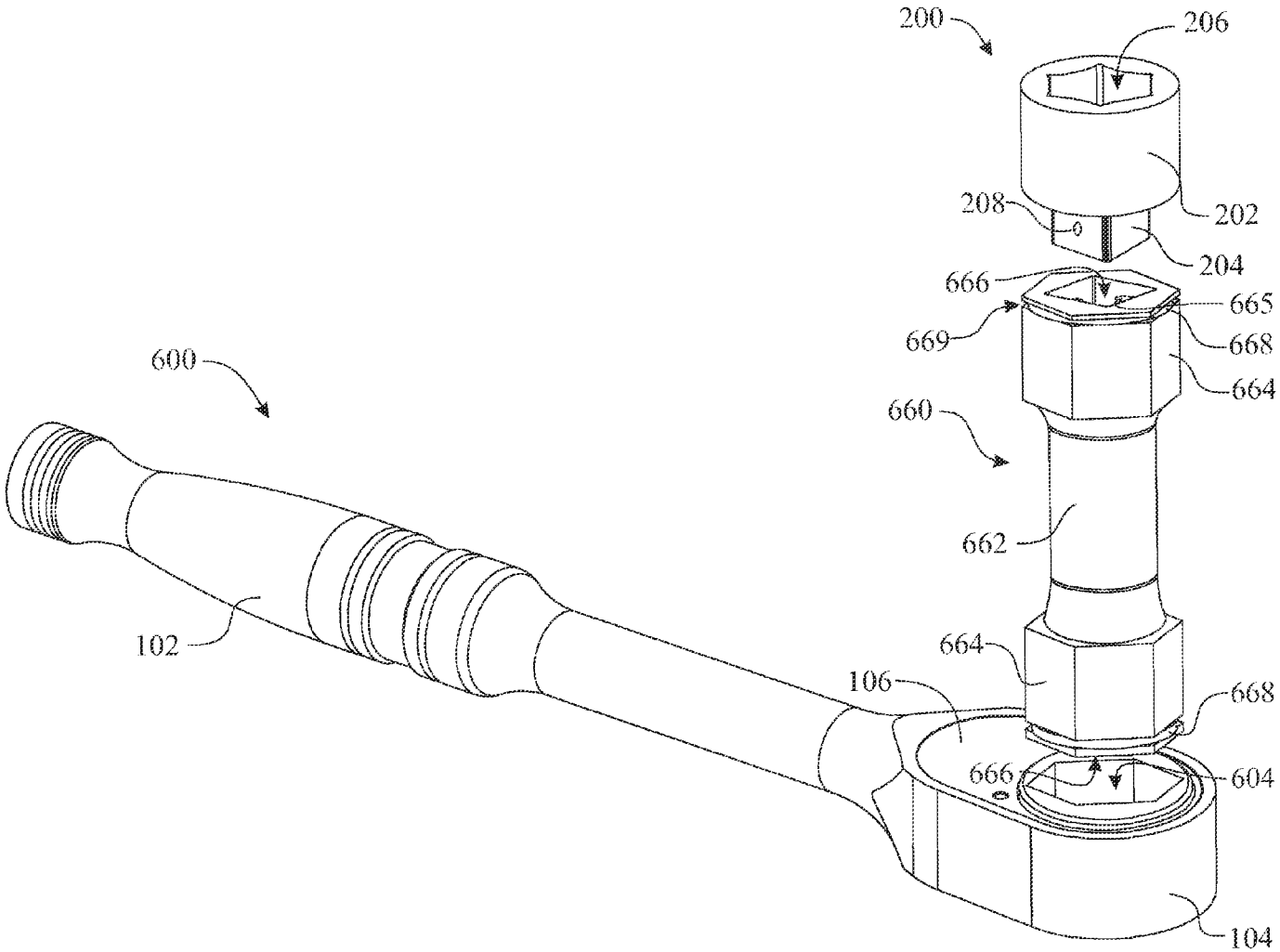
FIG. 46 presents an isometric view of the alternate hexagonally-shaped receptacle drive ratchet wrench of FIG. 36, the illustration further presenting a dual interface to dual interface extension and adapter, further including the low profile, plug-based drive socket.
Figure 47:
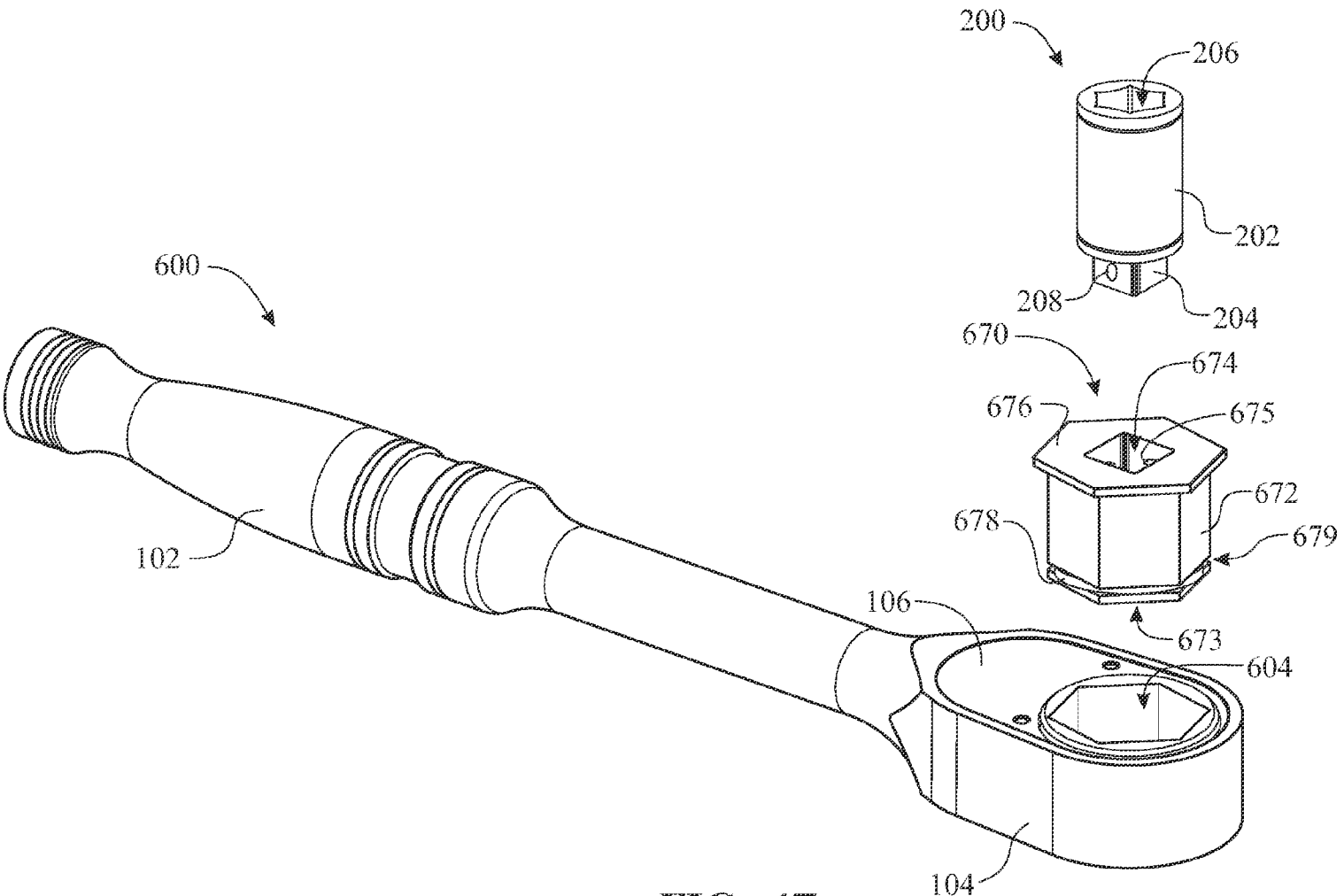
FIG. 47 presents an isometric view of the alternate hexagonally-shaped receptacle drive ratchet wrench of FIG. 36, the illustration further presenting a hexagonally-shaped receptacle to a square shaped receptacle adapter, further including the low profile, plug-based drive socket.
Figure 48:
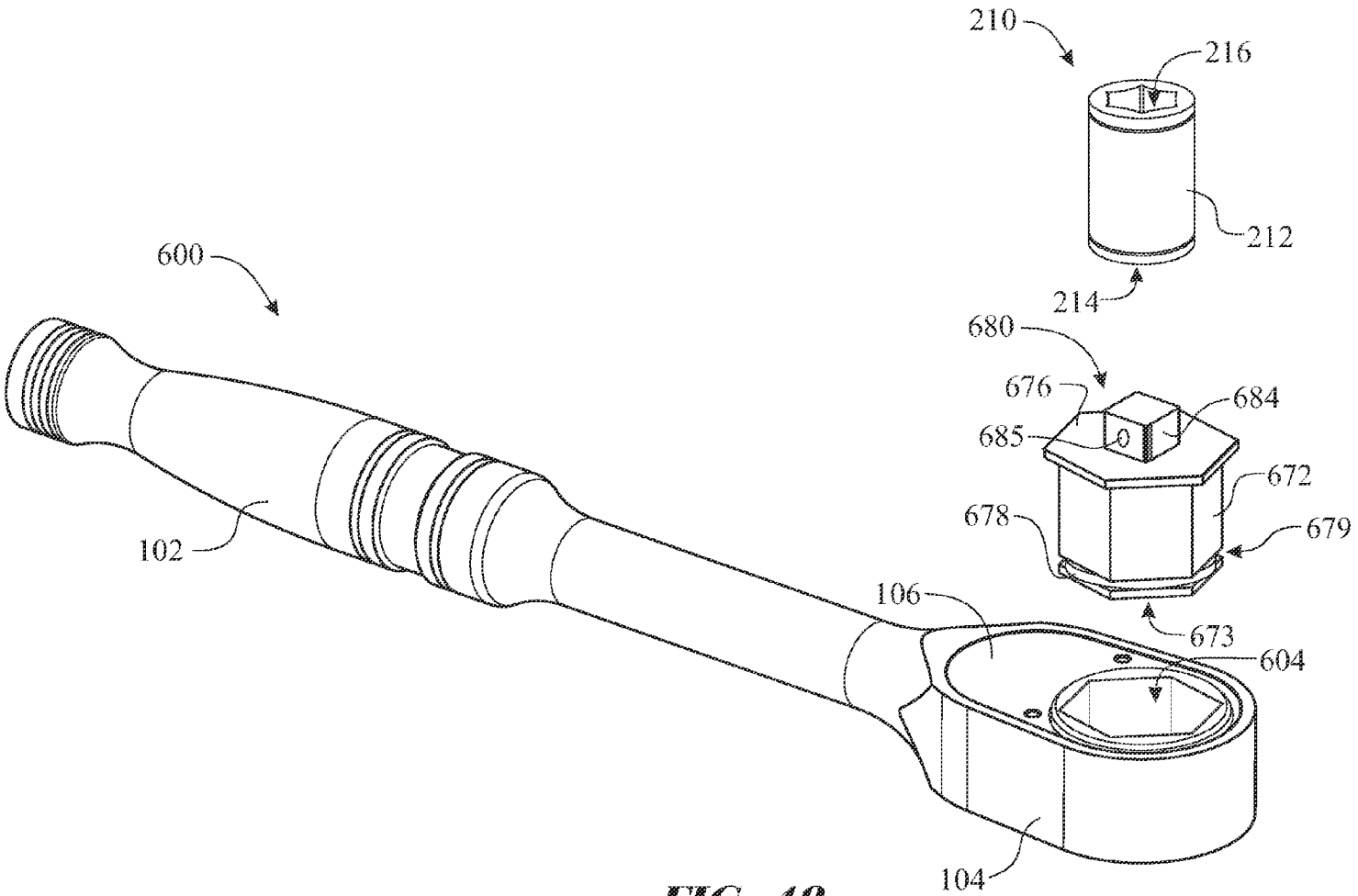
FIG. 48 presents an isometric view of the alternate hexagonally-shaped receptacle drive ratchet wrench of FIG. 36, the illustration further presenting a hexagonally-shaped receptacle to a square shaped plug adapter, further including a standard, receptacle-based drive socket.

Several embodiments of extensions and adapters are presented in FIGS. 46-49. An exemplary embodiment of a dual socket interface extension 660 is shown in FIG. 46. The dual socket interface extension 660 is fabricated having a plug drive section 664 disposed on each end of an extension body 662. A receptacle drive section 666 is provided within the distal end of the plug drive section 664 along the axial centerline. A ratchet locking bearing can be assembled to the plug drive section 664, or an alternate engaging mechanism such as a ratchet locking mechanism 668 can be incorporated, as shown. A locking mechanism receiving feature 669 is provided within each plug drive section 664 providing a receiver for a ratchet locking mechanism 668. The ratchet locking mechanism 668 can be an O-Ring, a metal snap ring, and the like, assembled within a locking mechanism receiving feature 669. These retention mechanisms provide a frictional fit between the plug drive section 664 and the hexagonally-shaped socket attachment receptacle 604, maintaining the extension with in the wrench during use. A locking bearing receiving detent 665 can be provided within each of the four sidewalls of the receptacle drive section 666 for receiving the ratchet locking bearing 208 of the plug-based drive socket 200. The dual socket interface extension 660 can alternatively be configured comprising a plug drive section 664/receptacle drive section 666 on a first end, and a ratchet drive plug (similar to a reconfigured plug drive section 684 as illustrated in FIG. 48) on the opposite end. The dual interface configuration provides the user the ability to utilize the dual socket interface extension 660 in conjunction with a standard plug-based drive ratchet 350 or in conjunction with a receptacle-based drive ratchet 600, providing a low profile configuration.

A receptacle socket drive adapter 670 is best illustrated in FIG. 47. The receptacle socket drive adapter 670 provides an adaptive interface between the hexagonally-shaped socket attachment receptacle 604 and the plug drive section 204 of a plug-based drive socket 200. The receptacle socket drive adapter 670 generally comprises an adapter body 672 having a first peripheral shape (shown as a hexagon) and a reconfigured receptacle drive section 674 having a second peripheral shape (shown as a square). Retention between two engaging components can be provided via any form of retention interface. One such exemplary retention interface is accomplished between a locking bearing and a locking bearing receiving detent 675. Another exemplary retention interface is accomplished between a ratchet locking mechanism 678, assembled within a locking mechanism receiving feature 679, where the ratchet locking mechanism 678 causes a frictional interface with the sidewalls of the hexagonally-shaped socket attachment receptacle 604. Alternatively, the adapter can include a flange 676, which contacts the outer surface of the receptacle-based drive gear 602. The flange 676 ensures that the receptacle socket drive adapter 670 does not pass through the hexagonally-shaped socket attachment receptacle 604. One exemplary design incorporates an axial length of the adapter body 672 being equal to, or longer than, the axial length of the hexagonally-shaped socket attachment receptacle 604. When the adapter body 672 is inserted through the hexagonally-shaped socket attachment receptacle 604, the ratchet locking mechanism 678 expands, removably securing the receptacle socket drive adapter 670 within the hexagonally-shaped socket attachment receptacle 604. The flange 676 can be incorporated onto the plug drive sections of any of the tools and would be desired for plug drives that pass through the receptacle-based drive gear 120, 602.

A plug socket drive adapter 680 is best illustrated in FIG. 48. The plug socket drive adapter 680 includes a majority of the features of the receptacle socket drive adapter 670 previously presented, while assembling or forming a reconfigured plug drive section 684 at an end opposite the receptacle drive section 673. A locking bearing 685 is assembled to at least one sidewall of the reconfigured plug drive section 684. The plug socket drive adapter 680 functions similarly to the receptacle socket drive adapter 670, while designed to interface with a standard receptacle-based socket 210.

Figure 49:
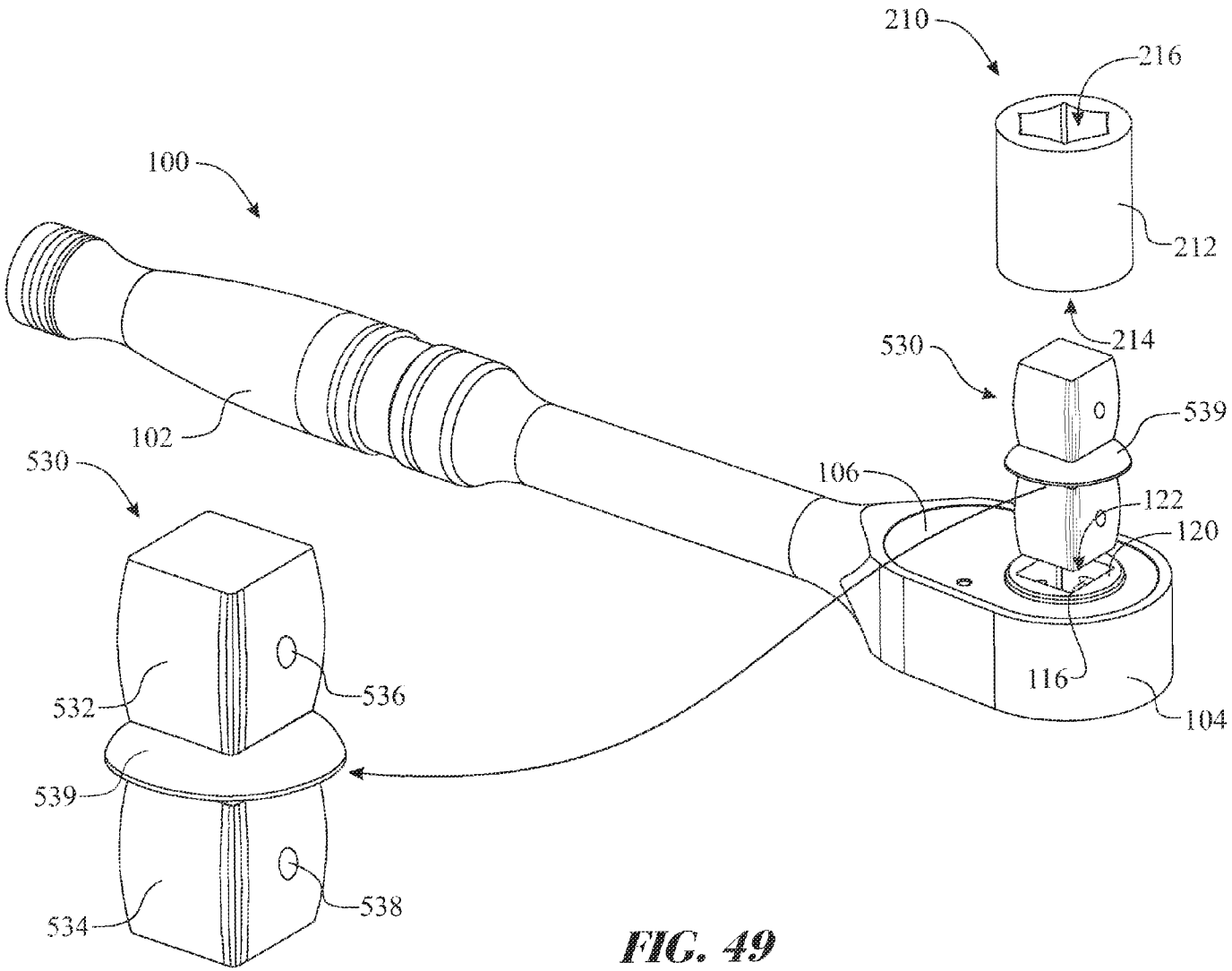
FIG. 49 presents an isometric view of the receptacle-based socket attaching interface ratchet wrench of FIG. 1, the illustration further presenting a wobble receptacle-based to standard wobble interface based converter incorporating a support flange and respective standard ratchet wrench interface socket.
Figure 50:
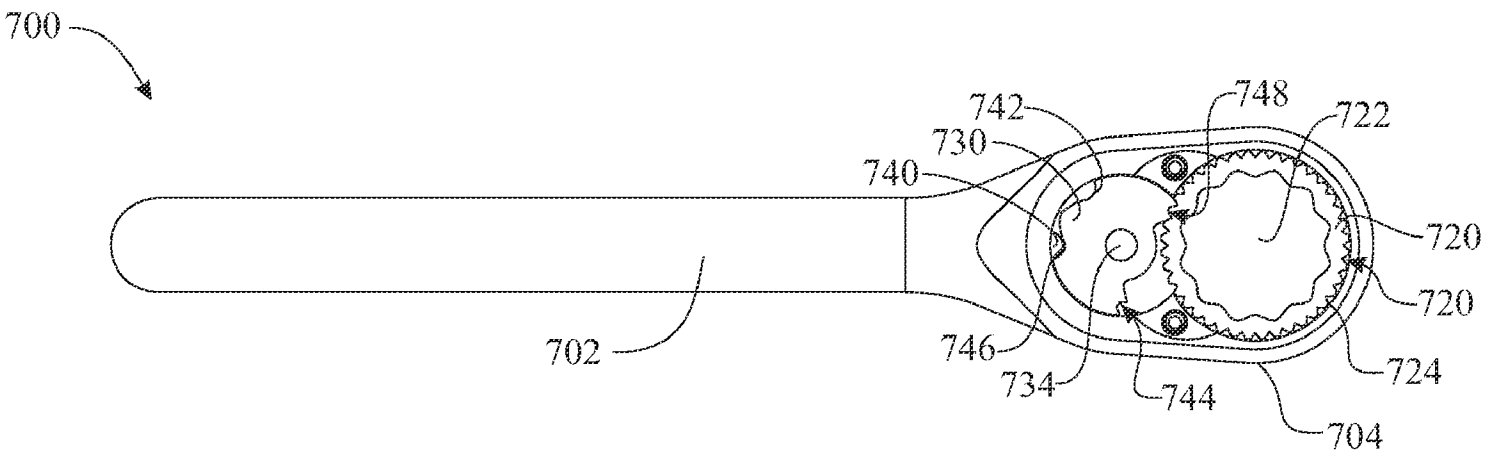
FIG. 50 presents a top plan view of an open drive ratchet wrench, including a cutaway section illustrating the working components thereof.

A wobble adapter 530 is best illustrated in FIG. 49. The wobble adapter 530 presents an alternate flange design, referred to as a wobble bit collar 539. The wobble bit collar 539 has domed surfaces allowing each of the wobble plug socket interface sections 532, 534 to wobble within the receptacle-based drive gear 120, 604. A socket locking bearing 536, 538 can be assembled to a sidewall of each of the wobble plug socket interface sections 532, 534 for removably securing the wobble adapter 530 to each connecting component.

An enhanced embodiment utilizes an open drive ratchet wrench 700 having a snap ring engaging drive gear 720 integrated therein with details being presented in FIGS. 50 through 53. Like features of the receptacle based drive ratchet 100 and the open drive ratchet wrench 700 are numbered the same except preceded by the numeral '7'. In the exemplary embodiment, the snap ring engaging drive gear 720 includes a socket attachment receptacle 722 passing therethrough. The snap ring engaging drive gear 720 is fabricated having a series of drive gear teeth 724 provided about a circumference of the gear. The drive gear teeth 724 operably engage with the drive teeth 744, 748 of the drive gear directional control 730 in a manner previously described herein. The socket attachment receptacle 722 is concentrically provided through the snap ring engaging drive gear 720 and is defined by a 723. The socket attachment receptacle 722 is shaped to snugly receive a mating receptacle drive section 615 of the dual socket interface socket 610. In the exemplary embodiment, the perimeter of the socket attachment receptacle 722 is shaped in a twelve (12) point pattern for mating with a six (6) point or a twelve (12) sided receptacle drive section 615. It is understood an alternate embodiment can shape the perimeter of the socket attachment receptacle 722 in a six (6) point pattern. It is understood that the shape of the perimeter of the socket attachment receptacle 722 would be compatible with the selected cross sectional shape of the receptacle drive section 615.

Figure 51:
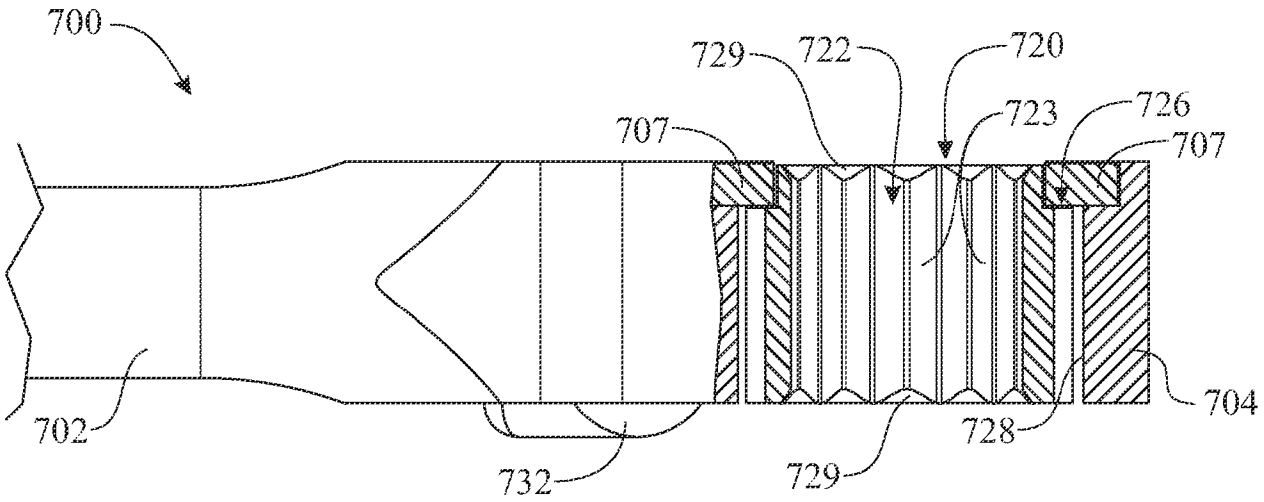
FIG. 51 presents a sectioned side elevation view of a ratchet drive section of the open drive ratchet wrench introduced in FIG. 50.
Figure 52:
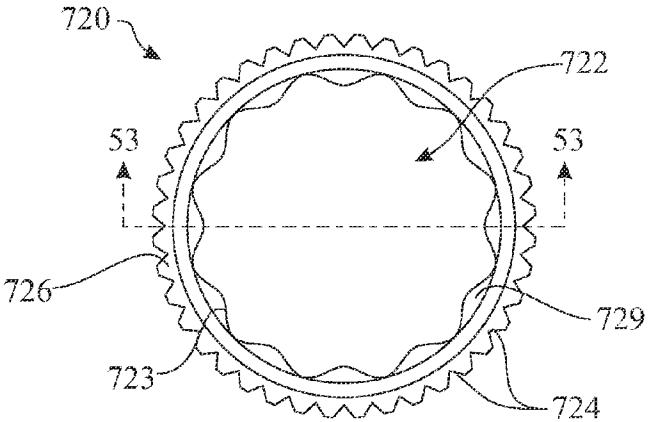
FIG. 52 presents a top plan view of a snap ring engaging drive gear removed from the open drive ratchet wrench.
Figure 53:
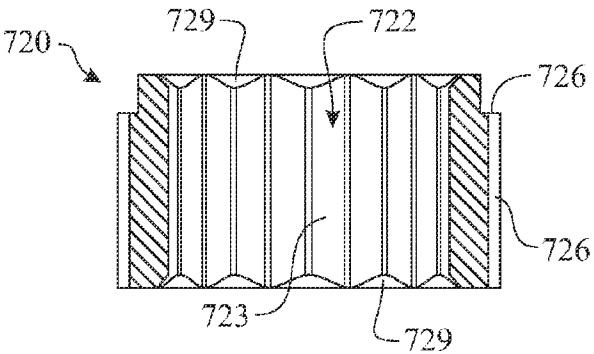
FIG. 53 presents a sectioned side elevation view of the snap ring engaging drive gear.
Figure 54:
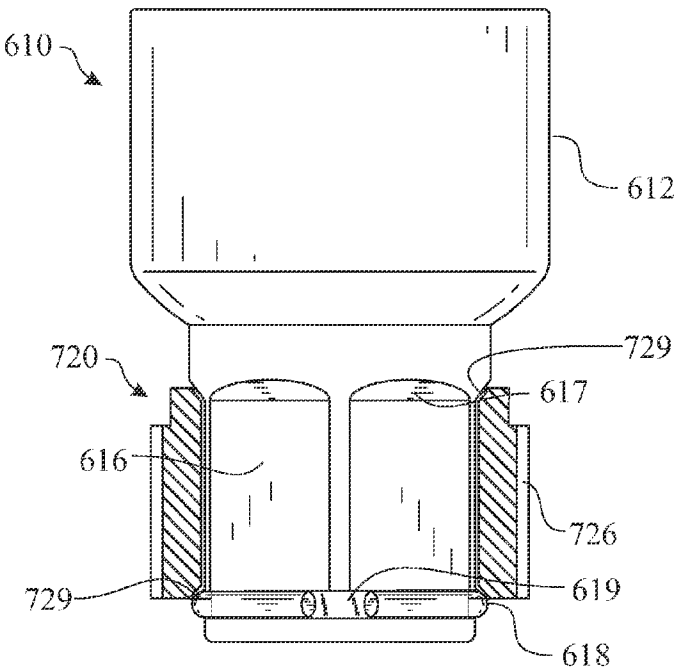
FIG. 54 presents an assembly side elevation view of the low profile dual interface socket being inserted into the snap ring engaging drive gear.

The snap ring engaging drive gear 720 is placed within a drive gear receiving cavity 728 of the ratchet drive section 704 as illustrated in FIG. 51. A drive gear assembly shoulder 726 is formed about an engaging perimeter of the snap ring engaging drive gear 720. The drive gear assembly shoulder 726 engages with a drive gear support flange 707 either formed within the ratchet drive section 704 or assembled to the ratchet drive section 704. A snap ring or similar device (not shown, but well understood) can be employed to retain the snap ring engaging drive gear 720 within the drive gear receiving cavity 728.

A chamfered edge 729 is formed about a peripheral edge of the snap ring engaging drive gear 720. The receptacle drive section 615 of the dual socket interface socket 610 is inserted into the socket attachment receptacle 722. The receptacle drive section 615 is shaped having a plurality of planar plug drive sections 616 disposed along an entire length of engagement. A drive transition section 617 is shaped, providing a transition between the planar plug drive section 616 and the body of the receptacle drive section 615. Each drive transition section 617 extends outward from the surface of the planar plug drive section 616 providing a seating interface, which rests upon the chamfered edge 729. A ratchet locking mechanism 618 is seated within a locking mechanism receiving feature 619 located at an opposite end of the planar plug drive section 616. The preferred embodiment utilises a ratchet locking mechanism 618 being a metal snap ring. The distance between the drive transition section 617 and the contacting edge of the ratchet locking mechanism 618 corresponds to the distance between each of the two chamfered edges 729. The chamfered edge 729 can be of any reasonable shape, angle, and size for mating with the planar plug drive section 616 and the ratchet locking mechanism 618.

Figure 55:
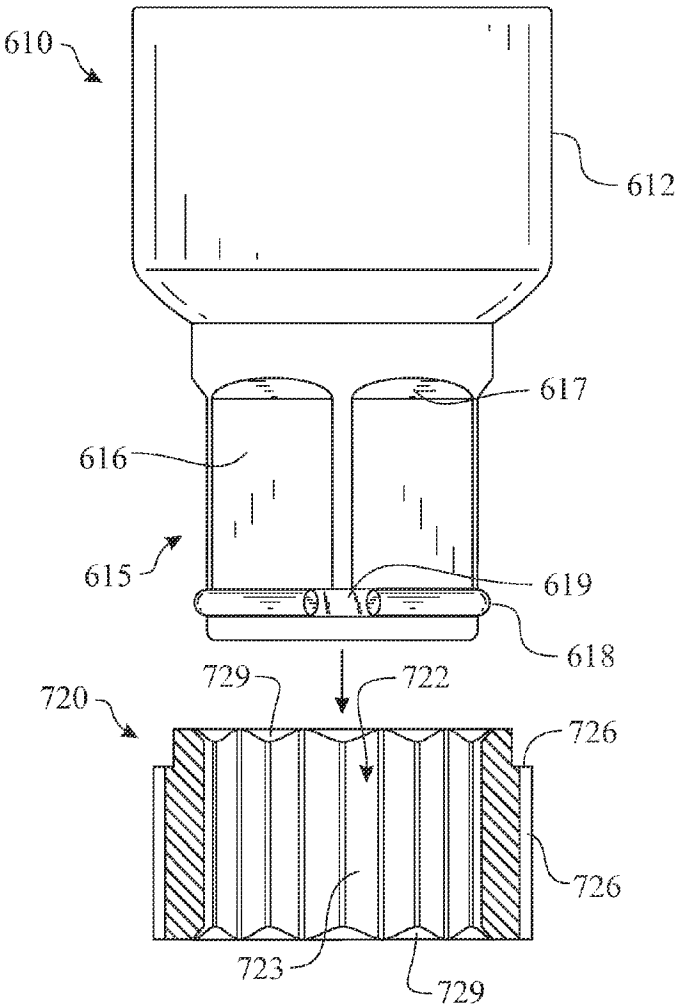
FIG. 55 presents an assembled side elevation view of the low profile dual interface socket as inserted into the snap ring engaging drive gear.

As the receptacle drive section 615 of the dual socket interface socket 610 is inserted into the socket attachment receptacle 722, the ratchet locking mechanism 618 collapses and retracts into the locking mechanism receiving feature 619. The receptacle wall 723 applies a pressure to the ratchet locking mechanism 618 to collapse the locking mechanism receiving feature 619. The locking mechanism receiving feature 619 includes a gap (as shown), which allows the respective diameter to shrink. The ratchet locking mechanism 618 is sized to remain retained by the locking mechanism receiving feature 619 when placed in a relaxed condition. The distance between the drive transition section 617 and the contacting edge of the ratchet locking mechanism 618 traps the receptacle drive section 615 within the socket attachment receptacle 722, spanning between each of the two chamfered edges 729. This ensures the dual socket interface socket 610 remains engaged within the snap ring engaging drive gear 720 as illustrated in FIG. 55.

An alternate embodiment provides a recess about a circumference of the receptacle wall 723 within the socket attachment receptacle 722. The ratchet locking mechanism 618 would engage with the recess.

This inventive combination provides several advantages over existing products. The spring supported ball bearing and recess combination requires a large planar surface for proper engagement. The present embodiment utilises a receptacle drive section 615 having six (6) sides. By providing a receptacle wall 723 having twelve (12) points, the user can select an optimal registration of the fastener head receiving section 614 (FIG. 40) respective to the open drive ratchet wrench 700 for use. This allows for finer angular increments for use. A second advantage over an o-ring is the extended life. A metal ring has an extended life compared to a rubber o-ring or similar device. A metal ring cannot be used for a frictional fit, as metal against metal has a low coefficient of friction. Hence, the utilisation of a metal snap ring as the ratchet locking mechanism 618 in combination with a chamfered 729 receptacle 722 ensures the dual socket interface socket 610 remains engaged with the snap ring engaging drive gear 720.

Figure 21:
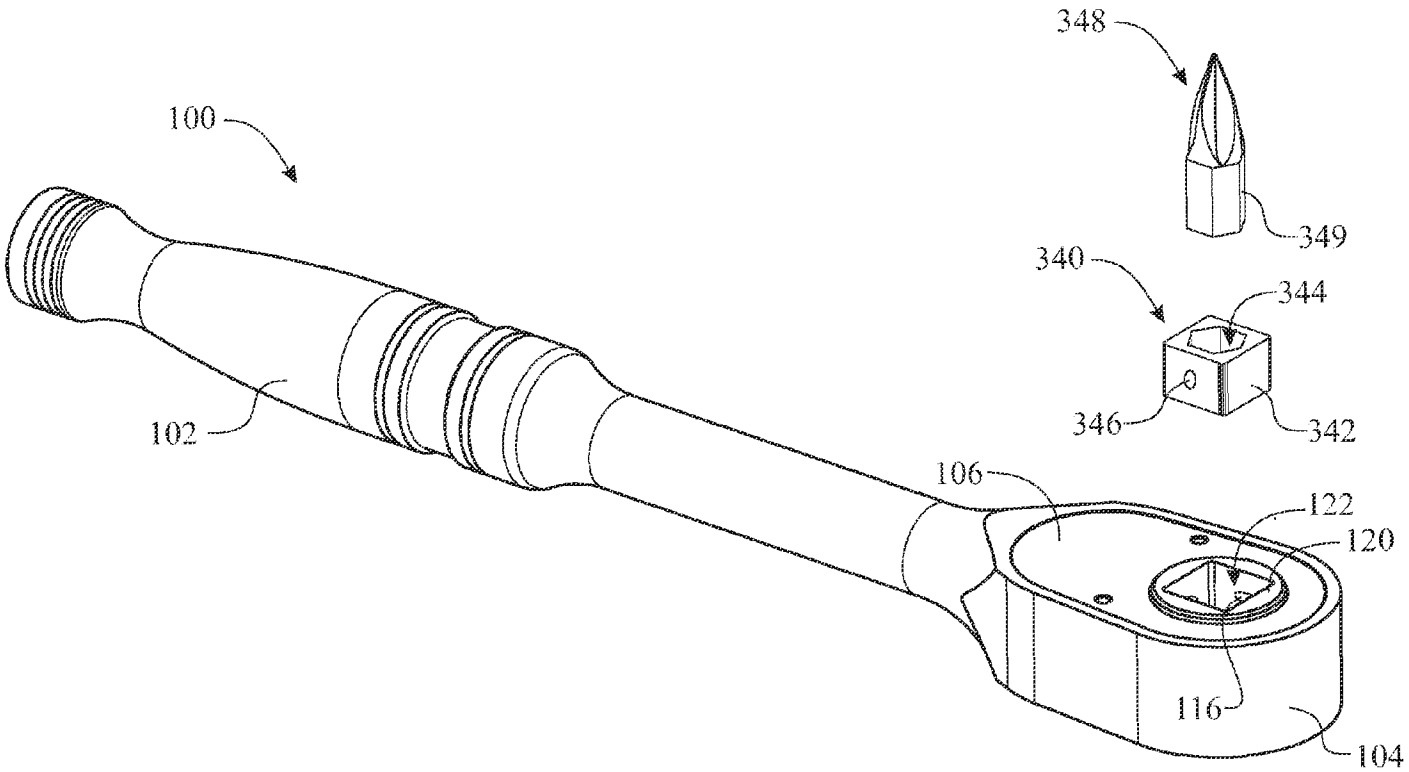
FIG. 21 presents an isometric view of the receptacle-based socket attaching interface ratchet wrench of FIG. 1, the illustration further presenting a receptacle to receptacle socket adapter, further including an exemplary drive tool.
Figure 57:
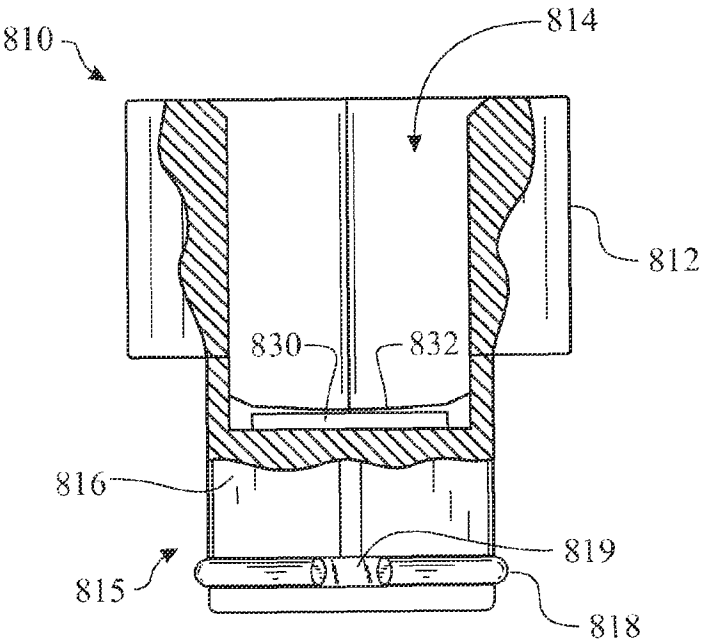
FIG. 57 presents a section partially sectioned view of the low profile hex drive adapter socket of FIG. 56.
Figure 56:
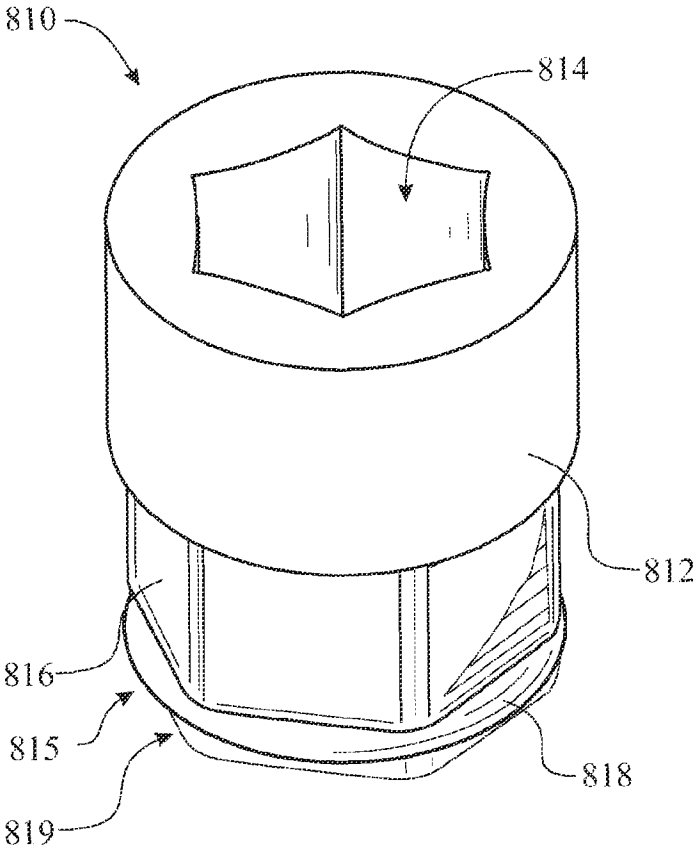
FIG. 56 presents a top isometric view of a low profile hex drive adapter socket.

An adapter for receiving a hexagonal based drive bit 348 (FIG. 21) into the snap ring engaging drive gear 720 (FIG. 50) is presented as a hex drive adapter socket 810 illustrated in FIGS. 56 and 57. The hex drive adapter socket 810 includes general features similar to that of the dual socket interface socket 610. Like features of the dual socket interface socket 610 and the hex drive adapter socket 810 are numbered the same except preceded by the numeral '8'. The hex drive receiving section 814 is sized to receive the tool bit hexagonal attaching section 349 (FIG. 21). A magnet 830 is placed into the base of the hex drive receiving section 814 for magnetically coupling with and retaining the hexagonal based drive bit 348 within the hex drive receiving section 814. A magnet stay 832 is fabricated of a spring type material and sized to retain the magnet 830 within the hex drive receiving section 814 as illustrated. The magnet stay 832 can have a circular peripheral edge, a hexagonal peripheral edge, or any other suitable shaped peripheral edge.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A combination of an open drive ratchet wrench and a drive tool having a releaseable interface therebetween, the combined drive ratchet wrench and drive tool comprising:

the open drive ratchet wrench comprising:

an open drive ratchet wrench body including an elongated handle having a ratchet drive section at a first end thereof;

a drive gear receiving cavity formed within the ratchet drive section; and, a drive gear rotationally retained within a drive gear receiving cavity, the drive gear comprising:

a socket attachment receptacle defined by a socket attachment receptacle surface concentrically passing through a longitudinal axis of the drive gear, a drive gear upper surface located at a first end of the drive gear, the drive gear upper surface defining a plane that is substantially perpendicular to the longitudinal axis, a drive gear lower surface located at an opposite end of the drive gear, the drive gear lower surface defining a plane that is substantially perpendicular to the longitudinal axis, a first chamfered surface providing an angled transition between the drive gear upper surface and an upper end of the socket attachment receptacle surface, and a second chamfered surface providing an angled transition between the drive gear lower surface and a lower end of the socket attachment receptacle surface;

the drive tool comprising:

a drive tool body having a fastener head receiving section at a first end and a concentric receptacle drive section at an opposite second end;

a drive tool receptacle drive section comprising a plurality of spaced-apart planar surfaces which are concentrically arranged about a drive tool central axis, each planar surface commencing at a distal end of the receptacle drive section and extending towards the fastener head receiving section, and terminating at a transition surface; and a releasable locking feature integrated into the receptacle drive section, the releasable locking feature comprising a snap ring positioned within a recess about a circumference of the receptacle drive section, wherein the snap ring is compressed into the recess when subjected to a compressive force, wherein, when the drive tool and the drive gear are secured to one another during use, the each transition surface seats against the first chamfered surface, between the drive gear upper surface and the upper end of the socket attachment receptacle surface and the snap ring seats against the second chamfered surface, between the drive gear lower surface and the lower end of the socket attachment receptacle surface in a manner releasably securing the drive tool to the drive gear.

2. A combination of an open drive ratchet wrench and a drive tool having a releaseable interface therebetween as recited in claim 1, the drive tool further comprising an internal socket drive interface concentric about the longitudinal axis, the internal socket drive interface defined by a non-circular fastener head receiving section cavity concentric about the longitudinal axis.

3. A combination of an open drive ratchet wrench and a drive tool having a releaseable interface therebetween as recited in claim 1, wherein the transition section is angled, wherein the angle engages with the first chamfered surface.

4. A combination of an open drive ratchet wrench and a drive tool having a releaseable interface therebetween as recited in claim 3, the drive tool further comprising an internal socket drive interface concentric about the central axis, the internal socket drive interface defined by a non-circular fastener head receiving cavity concentric about the central axis.

5. A combination of an open drive ratchet wrench and a drive tool having a releaseable interface therebetween as recited in claim 1, the drive tool further comprising a fastener head receiving cavity having a plurality of vertically disposed surfaces which are concentrically arranged about the central axis.

6. A combination of an open drive ratchet wrench and a drive tool having a releaseable interface therebetween as recited in claim 1, the drive tool further comprising a universal section.

7. A combination of an open drive ratchet wrench and a drive tool having a releaseable interface therebetween as recited in claim 1, the drive tool further comprising:

a hex drive receiving section having a sidewall concentrically arranged about the central axis and extending from an opening at a distal end and terminating at a hex drive receiving section base within the drive tool; and a magnet located at the hex drive receiving section base.

8. A combination of an open drive ratchet wrench and a drive tool having a releaseable interface therebetween as recited in claim 7, the drive tool further comprising a magnet stay arranged to secure the magnet within the hex drive receiving section and proximate the hex drive receiving section base.

9. A combination of an open drive ratchet wrench and a drive tool having a releaseable interface therebetween as recited in claim 1, the socket attachment receptacle further comprising a twelve point configuration.

10. A combination of an open drive ratchet wrench and a drive tool having a releaseable interface therebetween, comprising:

the open drive ratchet wrench comprising:

an open drive ratchet wrench body including an elongated handle having a ratchet drive section at a first end thereof;

a drive gear receiving cavity formed within the ratchet drive section; and, a drive gear rotationally retained within a drive gear receiving cavity, the drive gear comprising:

a socket attachment receptacle defined by a socket attachment receptacle surface concentrically passing through a longitudinal axis of the drive gear, a drive gear upper surface located at a first end of the drive gear, the drive gear upper surface defining a plane that is substantially perpendicular to the longitudinal axis, a drive gear lower surface located at an opposite end of the drive gear, the drive gear lower surface defining a plane that is substantially perpendicular to the longitudinal axis, a first chamfered surface providing an angled transition between the drive gear upper surface and an upper end of the socket attachment receptacle surface, and a second chamfered surface providing an angled transition between the drive gear lower surface and a lower end of the socket attachment receptacle surface;

the drive tool comprising:

a drive tool body having a fastener head receiving section at a first end and a concentric receptacle drive section at an opposite second end;

a drive tool receptacle drive section comprising six planar surfaces in a hexagonal arrangement which are concentrically arranged about a drive tool central axis, each planar surface commencing at a distal end of the receptacle drive section and extending towards the fastener head receiving section, and terminating at a transition surface; and a releasable locking feature integrated into the receptacle drive section, the releasable locking feature comprising a snap ring positioned within a recess about a circumference of the receptacle drive section, wherein the snap ring is compressed into the recess when subjected to a compressive force, wherein, when the drive tool and the drive gear are secured to one another during use, each transition surface seats against the first chamfered surface, between the drive gear upper surface and the upper end of the socket attachment receptacle surface and the snap ring seats against the second chamfered surface, between the drive gear lower surface and the lower end of the socket attachment receptacle surface in a manner releasably securing the drive tool to the drive gear.

11. A combination of an open drive ratchet wrench and a drive tool having a releaseable interface therebetween as recited in claim 10, the drive tool further comprising an internal socket drive interface concentric about the central axis, the internal socket drive interface defined by a non-circular fastener head receiving cavity concentric about the central axis.

12. A combination of an open drive ratchet wrench and a drive tool having a releaseable interface therebetween as recited in claim 10, wherein the transition section is angled, wherein the angle engages with the first chamfered surface.

13. A combination of an open drive ratchet wrench and a drive tool having a releaseable interface therebetween as recited in claim 10, the drive tool further comprising a fastener head receiving cavity having a plurality of vertically disposed surfaces which are concentrically arranged about the central axis.

14. A combination of an open drive ratchet wrench and a drive tool having a releaseable interface therebetween as recited in claim 10, the drive tool further comprising a universal section.

15. A combination of an open drive ratchet wrench and a drive tool having a releaseable interface therebetween as recited in claim 10, the drive tool further comprising:

a hex drive receiving section having a sidewall concentrically arranged about the central axis and extending from an opening at a distal end and terminating at a hex drive receiving section base within the drive tool; and a magnet located at the hex drive receiving section base.

16. A combination of an open drive ratchet wrench and a drive tool having a releaseable interface therebetween as recited in claim 15, the drive tool further comprising a magnet stay arranged to secure the magnet within the hex drive receiving section and proximate the hex drive receiving section base.

17. A combination of an open drive ratchet wrench and a drive tool having a releaseable interface therebetween as recited in claim 10, the socket attachment receptacle further comprising a twelve point configuration.

18. A combination of an open drive ratchet wrench and a drive tool having a releaseable interface therebetween, comprising:

the open drive ratchet wrench comprising:

an open drive ratchet wrench body including an elongated handle having a ratchet drive section at a first end thereof;

a drive gear receiving cavity formed within the ratchet drive section; and, a drive gear rotationally retained within a drive gear receiving cavity, the drive gear comprising:

a socket attachment receptacle defined by a socket attachment receptacle surface concentrically passing through a longitudinal axis of the drive gear, a drive gear upper surface located at a first end of the drive gear, the drive gear upper surface defining a plane that is substantially perpendicular to the longitudinal axis, a drive gear lower surface located at an opposite end of the drive gear, the drive gear lower surface defining a plane that is substantially perpendicular to the longitudinal axis, a first chamfered surface providing an angled transition between the drive gear upper surface and an upper end of the socket attachment receptacle surface, and a second chamfered surface providing an angled transition between the drive gear lower surface and a lower end of the socket attachment receptacle surface;

a drive gear directional control selectively engaged with a series of drive gear teeth provided about an outer periphery of the drive gear, the drive gear directional control alternating between a clockwise rotation and a counterclockwise direction of applied torque onto the drive gear; and the drive tool comprising:

a drive tool body having a fastener head receiving section at a first end and a concentric receptacle drive section at an opposite second end;

a drive tool receptacle drive section comprising a plurality of spaced-apart planar surfaces which are concentrically arranged about a drive tool central axis, each planar surface commencing at a distal end of the receptacle drive section and extending towards the fastener head receiving section, and terminating at a transition surface; and a releasable locking feature integrated into the receptacle drive section, the releasable locking feature comprising a snap ring positioned within a recess about a circumference of the receptacle drive section, wherein the snap ring is compressed into the recess when subjected to a compressive force, wherein, when the drive tool and the drive gear are secured to one another during use, the each transition surface seats against the first chamfered surface, between the drive gear upper surface and the upper end of the socket attachment receptacle surface and the snap ring seats against the second chamfered surface, between the drive gear lower surface and the lower end of the socket attachment receptacle surface in a manner releasably securing the drive tool to the drive gear.

19. A combination of an open drive ratchet wrench and a drive tool having a releaseable interface therebetween as recited in claim 18, the drive tool further comprising an internal socket drive interface concentric about the central axis, the internal socket drive interface defined by a non-circular fastener head receiving cavity concentric about the central axis.

20. A combination of an open drive ratchet wrench and a drive tool having a releaseable interface therebetween as recited in claim 18, wherein the transition section is angled, wherein the angle engages with the chamfered surfaces.

21. A combination of an open drive ratchet wrench and a drive tool having a releaseable interface therebetween as recited in claim 18, the drive tool further comprising a fastener head receiving cavity having a plurality of vertically disposed surfaces which are concentrically arranged about the central axis.

22. A combination of an open drive ratchet wrench and a drive tool having a releaseable interface therebetween as recited in claim 18, the drive tool further comprising a universal section.

23. A combination of an open drive ratchet wrench and a drive tool having a releaseable interface therebetween as recited in claim 18, the drive tool further comprising:

a hex drive receiving section having a sidewall concentrically arranged about the central axis and extending from an opening at a distal end and terminating at a hex drive receiving section base within the drive tool; and a magnet located at the hex drive receiving section base.

24. A combination of an open drive ratchet wrench and a drive tool having a releaseable interface therebetween as recited in claim 23, the drive tool further comprising a magnet stay arranged to secure the magnet within the hex drive receiving section and proximate the hex drive receiving section base.

25. A combination of an open drive ratchet wrench and a drive tool having a releaseable interface therebetween as recited in claim 18, the socket attachment receptacle further comprising a twelve point configuration.

* * * * *